US012662822B2

(12) United States Patent
Iannacone, III

(10) Patent No.: US 12,662,822 B2
(45) **Date of Patent: *Jun. 23, 2026**

(54) LUXURY VINYL PLANK STAIR NOSES AND OTHER MOLDINGS

(71) Applicant: Finished Edge Technology LLC, Tempe, AZ (US)

(72) Inventor: Charles Paul Iannacone, III, Apache Junction, AZ (US)

(73) Assignee: Finished Edge Technology LLC, Tempe, AZ (US)

( * ) Notice: Subject to any disclaimer, the term of this patent is extended or adjusted under 35 U.S.C. 154(b) by 194 days.

This patent is subject to a terminal disclaimer.

(21) Appl. No.: 18/399,929

(22) Filed: Dec. 29, 2023

(65) Prior Publication Data

US 2024/0133183 A1 Apr. 25, 2024

Related U.S. Application Data

(63) Continuation of application No. 17/336,925, filed on Jun. 2, 2021, now Pat. No. 11,873,645.

(60) Provisional application No. 63/034,204, filed on Jun. 3, 2020.

(51) Int. Cl.
*E04F 11/16* (2006.01)
*E04F 11/104* (2006.01)

(52) U.S. Cl.
CPC ..... *E04F 11/163* (2013.01); *E04F 11/1045* (2013.01); *E04F 2203/08* (2013.01)

(58) Field of Classification Search
CPC ..... E04F 11/166; E04F 11/175; E04F 11/104; E04F 11/1045; E04F 11/108; E04F 11/16; E04F 11/163; E04F 11/17; E04F 15/02005; E04F 19/062; E04F 19/065
USPC ..... 52/174, 179, 188, 190, 302.1
See application file for complete search history.

(56) References Cited

U.S. PATENT DOCUMENTS

| | | | | |
|---|---|---|---|---|
| 3,903,663 A | | 9/1975 | Bainter et al. | |
| 4,024,684 A | | 5/1977 | Holmgren | |
| 4,262,514 A | | 4/1981 | Howell et al. | |
| 4,783,939 A | | 11/1988 | Bergmann et al. | |
| 4,893,449 A | * | 1/1990 | Kemper | E04F 19/066 52/717.06 |

(Continued)

FOREIGN PATENT DOCUMENTS

| | | | | |
|---|---|---|---|---|
| AT | 11538 U1 | * | 12/2010 | E04F 11/108 |
| CN | 105332482 A | | 2/2016 | |

(Continued)

OTHER PUBLICATIONS

Zamma Corporation, Cap-A-Tread, https://www.zamma.com/cap-a-tread.html, downloaded Jun. 2, 2021.

*Primary Examiner* — Ryan D Kwiecinski
(74) *Attorney, Agent, or Firm* — Brian M. Kaufman; Robert D. Atkins; PATENT LAW GROUP: Atkins and Associates, P.C.

(57) ABSTRACT

A molding is made from a first flooring plank. A first groove is formed into the first flooring plank with a first flat bottom surface. A second groove is formed into the first flooring plank with a second flat bottom surface. The first flooring plank is folded at the first groove and second groove. A second flooring plank is disposed adjacent to the molding. A color and pattern of the first flooring plank and second flooring plank match.

20 Claims, 17 Drawing Sheets

(56) References Cited

U.S. PATENT DOCUMENTS

| | | | | |
|---|---|---|---|---|
| 5,657,598 | A * | 8/1997 | Wilbs | A47G 27/045 52/287.1 |
| 5,787,674 | A * | 8/1998 | Nelson | E04F 11/166 52/741.2 |
| 6,446,399 | B1 | 9/2002 | Lecours | |
| 7,329,456 | B2 | 2/2008 | Tilton et al. | |
| 8,312,754 | B2 | 11/2012 | Lewis et al. | |
| 8,572,912 | B2 * | 11/2013 | Neuhofer, Jr. | E04F 19/0463 52/287.1 |
| 9,399,874 | B2 | 7/2016 | Spielman | |
| 10,883,280 | B2 * | 1/2021 | Decruy | E04F 19/04 |
| 11,111,676 | B2 | 9/2021 | Nedza | |
| 2001/0031336 | A1 | 10/2001 | Born | |
| 2006/0150539 | A1 | 7/2006 | Vanhastel et al. | |
| 2006/0150565 | A1 * | 7/2006 | Schacht | E04F 19/062 52/716.1 |
| 2008/0034696 | A1 * | 2/2008 | Neuhofer | E04F 19/065 52/466 |
| 2008/0105372 | A1 * | 5/2008 | Neuhofer | E04F 19/065 156/280 |
| 2009/0145059 | A1 | 6/2009 | Kay | |
| 2010/0218448 | A1 * | 9/2010 | Schacht | E04F 19/062 52/464 |
| 2010/0242382 | A1 | 9/2010 | Pearson et al. | |
| 2011/0005159 | A1 | 1/2011 | Lee | |
| 2011/0146168 | A1 | 6/2011 | van Genderen | |
| 2011/0252725 | A1 | 10/2011 | Glorgio | |
| 2013/0167464 | A1 * | 7/2013 | Stanchfield | E04F 19/061 52/468 |
| 2013/0305635 | A1 * | 11/2013 | McCool | E04F 11/108 52/741.2 |
| 2014/0026500 | A1 | 1/2014 | Spielman | |
| 2014/0130430 | A1 | 5/2014 | McCool | |
| 2014/0174005 | A1 | 6/2014 | Richard et al. | |
| 2016/0010338 | A1 * | 1/2016 | Steijvers | E04F 11/175 52/741.1 |
| 2016/0222673 | A1 | 8/2016 | Brink | |
| 2018/0135313 | A1 * | 5/2018 | Chen | C08K 5/0016 |
| 2019/0032343 | A1 * | 1/2019 | Decruy | E04F 19/062 |
| 2019/0161975 | A1 * | 5/2019 | Simon | E04F 15/105 |
| 2020/0131779 | A1 * | 4/2020 | Nedza | B32B 27/12 |
| 2023/0001604 | A1 | 1/2023 | Cappelle et al. | |

FOREIGN PATENT DOCUMENTS

| | | | | | |
|---|---|---|---|---|---|
| CN | 108086608 | A | | 5/2018 | |
| CN | 111101666 | A | | 5/2020 | |
| CN | 114232919 | A | * | 3/2022 | E04F 11/16 |
| DE | 4310768 | C1 | | 5/1994 | |
| DE | 102004026378 | A1 | * | 12/2005 | E04F 11/108 |
| DE | 202012005602 | U1 | * | 11/2012 | E04F 19/066 |
| DE | 202018003793 | U1 | | 9/2018 | |
| DE | 202023103920 | U1 | | 8/2023 | |
| EP | 2700765 | A2 | * | 2/2014 | B32B 3/266 |
| FR | 2903132 | A1 | * | 1/2008 | E04F 19/061 |
| FR | 2957373 | A1 | * | 9/2011 | E04F 19/063 |
| JP | 2000179121 | A | * | 6/2000 | |
| JP | 2020117951 | A | | 8/2020 | |
| WO | WO-2007091138 | A1 | * | 8/2007 | E04F 19/061 |
| WO | 2010111030 | A2 | | 9/2010 | |
| WO | 2012024813 | A1 | | 3/2012 | |
| WO | WO-2016051100 | A1 | * | 4/2016 | B26F 3/002 |

* cited by examiner

LUXURY VINYL PLANK STAIR NOSES AND OTHER MOLDINGS

CLAIM OF DOMESTIC PRIORITY

The present application is a continuation of U.S. patent application Ser. No. 17/336,925, now U.S. Pat. No. 11,873,645, filed Jun. 2, 2021, which claims the benefit of U.S. Provisional Application No. 63/034,204, filed Jun. 3, 2020, which applications are incorporated herein by reference.

FIELD OF THE INVENTION

The present invention relates in general to stair noses and other moldings made from luxury vinyl plank flooring, and to methods, tools, and machines for forming the stair noses and other moldings from luxury vinyl plank flooring.

BACKGROUND OF THE INVENTION

Flooring manufacturers and installers have tried many different methods for providing custom stair noses that match the surrounding floor. Typical methods involve cutting off the existing stair nose and then installing a replacement stair nose closely matching the floor being installed, as shown in FIGS. 1*a*-1*d*. FIG. 1*a* illustrates a stair step 10 with a tread 12 and riser 14. Nose 16 is a part of tread 12 delineated with a dotted line to show where the nose will be cut off. FIG. 1B illustrates a floor plank 20 with a replacement nose 22 being installed over tread 12. Nose 22 is pretty similar to nose 16 that was already part of the underlying tread 12, but is designed to reasonably match the color and pattern of flooring being installed in an adjacent room.

FIG. 1*c* illustrates continuing to install flooring planks 30 next to nose plank 20. FIG. 1*d* shows plank 30 installed. Additional flooring planks 30 will continue to be installed next to each other to fully cover the stair tread or perhaps an entire room in the case of the top step.

One problem that occurs with replacing stair treads along with the rest of the adjacent flooring is matching the wood grain pattern and color. Even when the exact same type of wood and finish is used for both nose plank 20 and flooring plank 30, the color and pattern are usually off. All the floor planks 30 being used are usually made together at the same factory at the same time to match practically exactly. However, nose planks 20 are typically formed separately and, while they may match flooring planks 30 closely, will almost always have a noticeable difference in color and pattern due to being manufactured at a different time or even a different factory.

Luxury vinyl plank (LVP) flooring is a modern type of flooring that is susceptible to the problems of color matching stair nosing and other molding. FIG. 2*a* shows a cross-sectional view of one plank 50 of LVP flooring. LVP flooring is typically formed of a core 52, padding 54, an image layer 56, and a clearcoat finish 58 formed over the image layer. Core 52 is commonly a stone polymer or wood-plastic composite. A stone polymer core 52 is composed of calcium carbonate (limestone), polyvinyl chloride (PVC), and optionally plasticizers. Wood-plastic composite cores are similarly composed, with the addition of a wood product, such as sawdust or wood flour. A foaming agent may be added to soften the floor made with planks 50.

The desired design for the flooring is printed on image layer 56 and then attached to core 52. Image layer 56 can be a vinyl sheet or another printable substrate. Clearcoat layer 58 typically consists of anywhere from 1 to 100 layers of clearcoat or more. Usually between 10 and 25 layers of clearcoat are used. Clearcoat layer 58 protects the printed image layer 56, and plank 50 as a whole, from wear.

Luxury vinyl plank flooring is typically formed with connectors 60 around the perimeter of planks 50 so that individual planks can be clicked or snapped together with other adjacent planks to easily form a floor with proper alignment and a seamless transition between planks. FIG. 2*a* shows a connector 60*a* on one side of plank 50 and a connector 60*b* on the other side. When two pieces of LVP flooring 50*a* and 50*b* are slid together as shown in FIGS. 2*b* and 2*c*, connector 60*a* of one plank and connector 60*b* of the other plank slide into each other. A detent is commonly used to snap the connectors together, maintaining alignment and eliminating visible gaps between planks.

While LVP flooring makes installing a beautiful floor easier, LVP does not eliminate the problems of matching stair nosing to the surrounding flooring. The closest matching hardwood nosing is usually used even though the vinyl planks are printed. Achieving an exact match is very difficult. Therefore, a need exists for an improved stair nose, as well as other types of molding, that matches LVP flooring planks.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

One solution to providing stair noses that match luxury vinyl plank (LVP) flooring is to make the stair noses out of the same LVP planks that are being installed for the flooring. Using the same planks for both stair noses and the rest of the flooring means that the stair nose planks are manufactured at the same plant and under the same conditions as the rest of the flooring planks. The issues in the prior art with slight variations in manufacturing conditions resulting in slightly off colors and patterns are eliminated because stair nosing and floor planks are manufactured together.

Figure 1B:
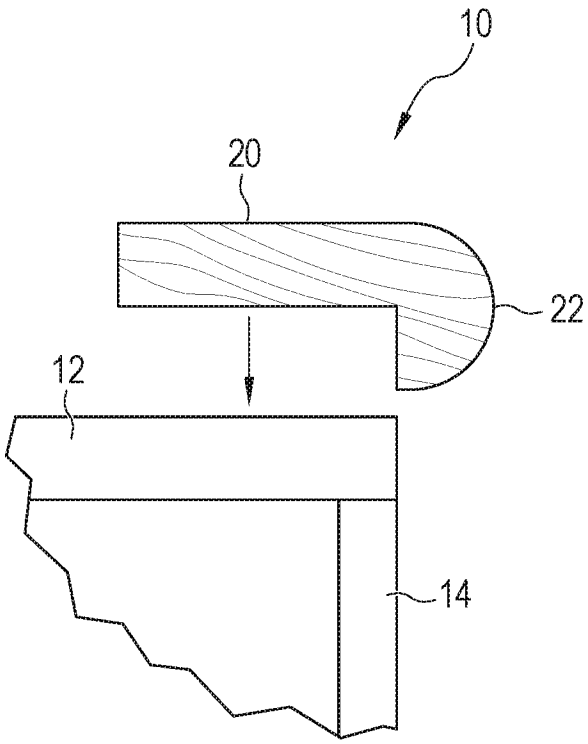
FIG. 1b (PRIOR ART)
FIGS. 1*a*-1*d* illustrate replacing a stair nose as part of installing flooring.
Figure 1A:
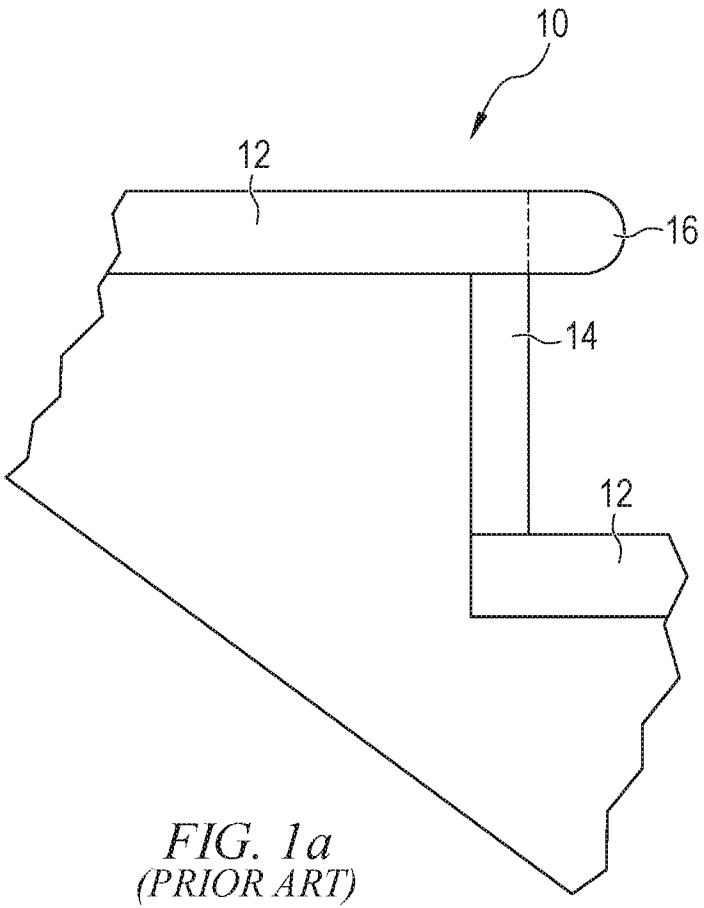
FIG. 1a (PRIOR ART)
Figure 1C:
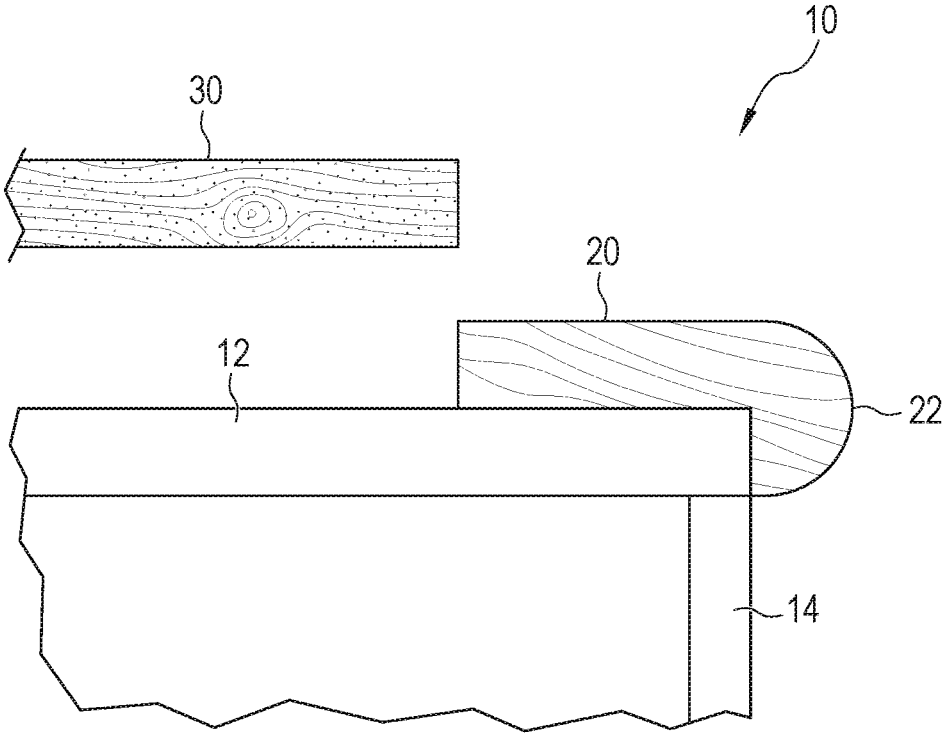
FIG. 1c (PRIOR ART)
Figure 1D:
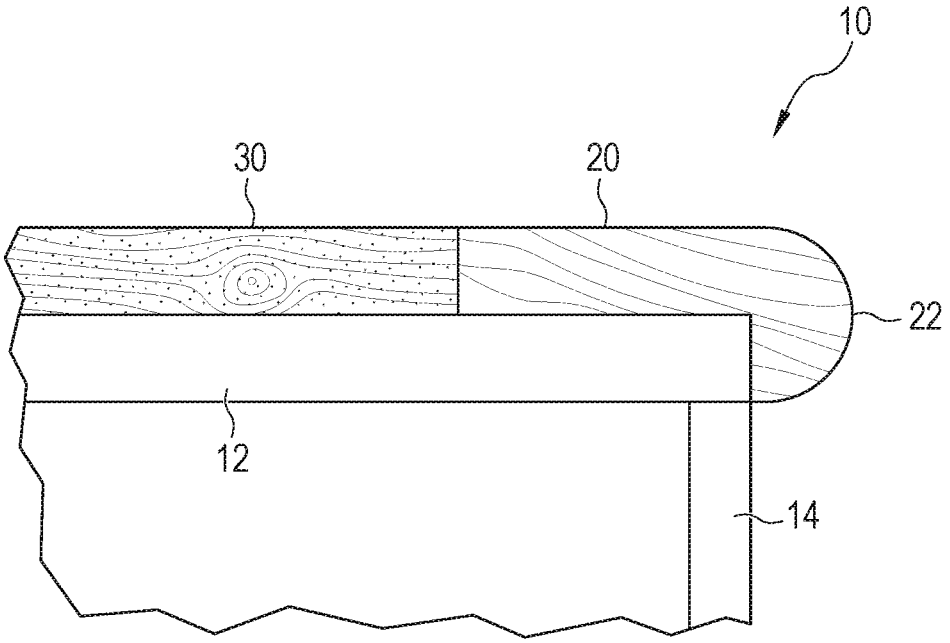
FIG. 1d (PRIOR ART)
Figure 2A:
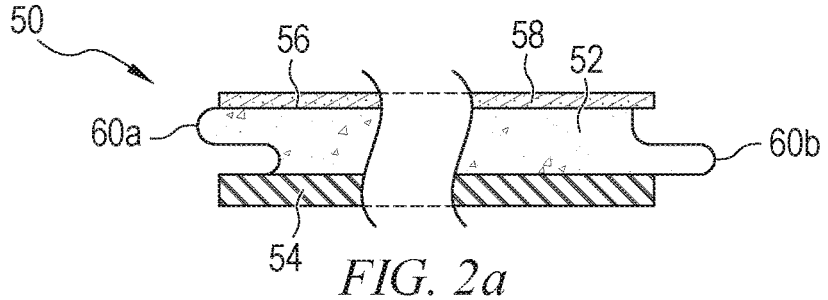
FIG. 2a (PRIOR ART)
FIGS. 2*a*-2*c* illustrate luxury vinyl plank flooring.
Figure 2B:
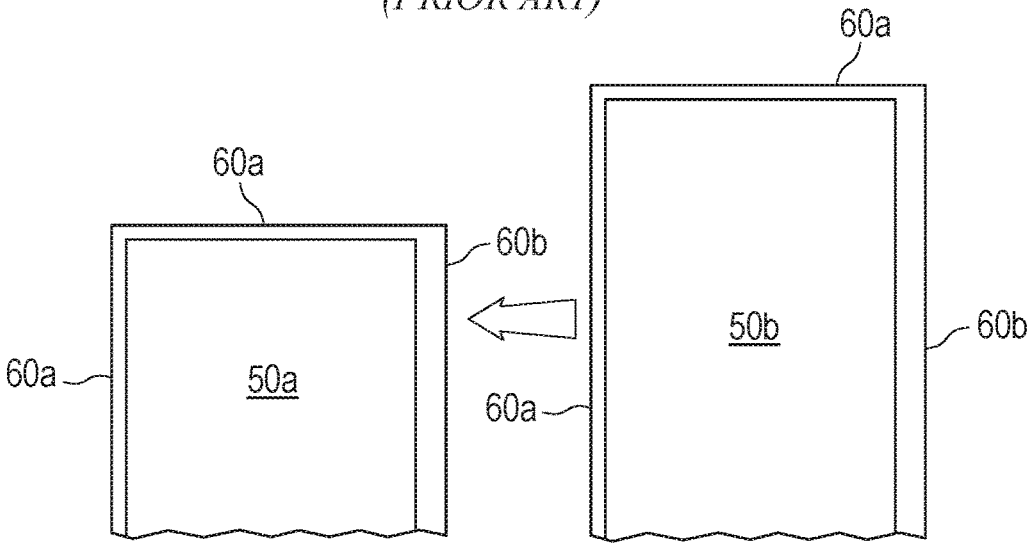
FIG. 2b (PRIOR ART)
Figure 2C:
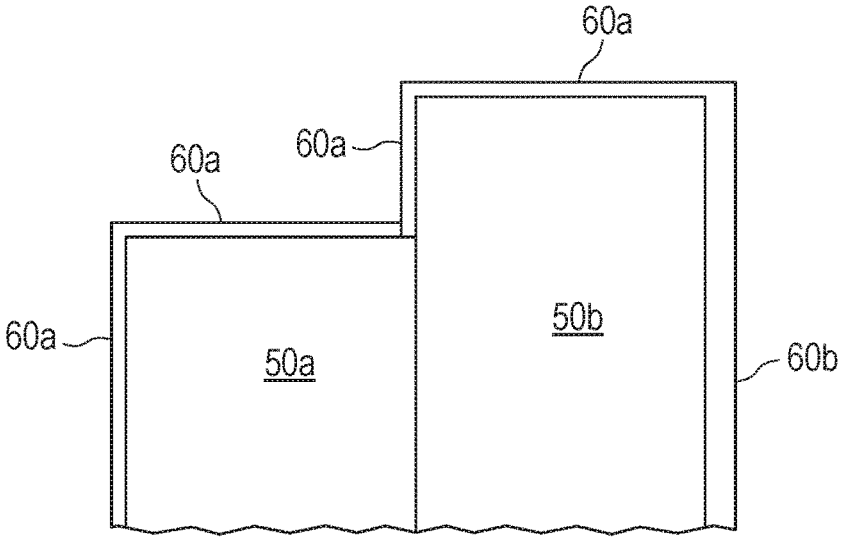
FIG. 2c (PRIOR ART)
Figure 3C:
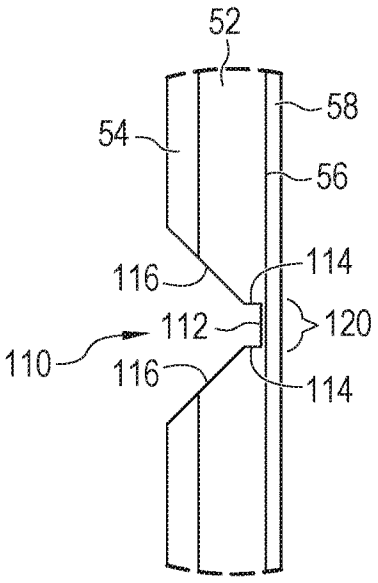
FIGS. 3*a*-3*i* illustrate cutting and folding a luxury vinyl plank to form a stair nose.
Figure 3B:
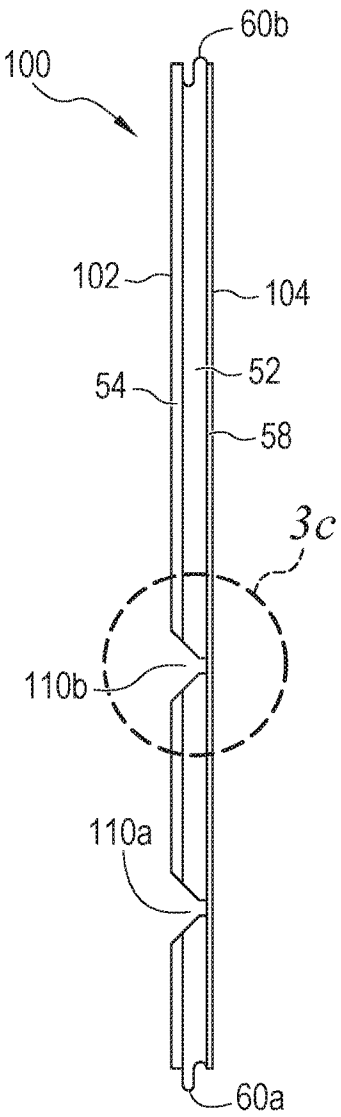
Figure 3A:
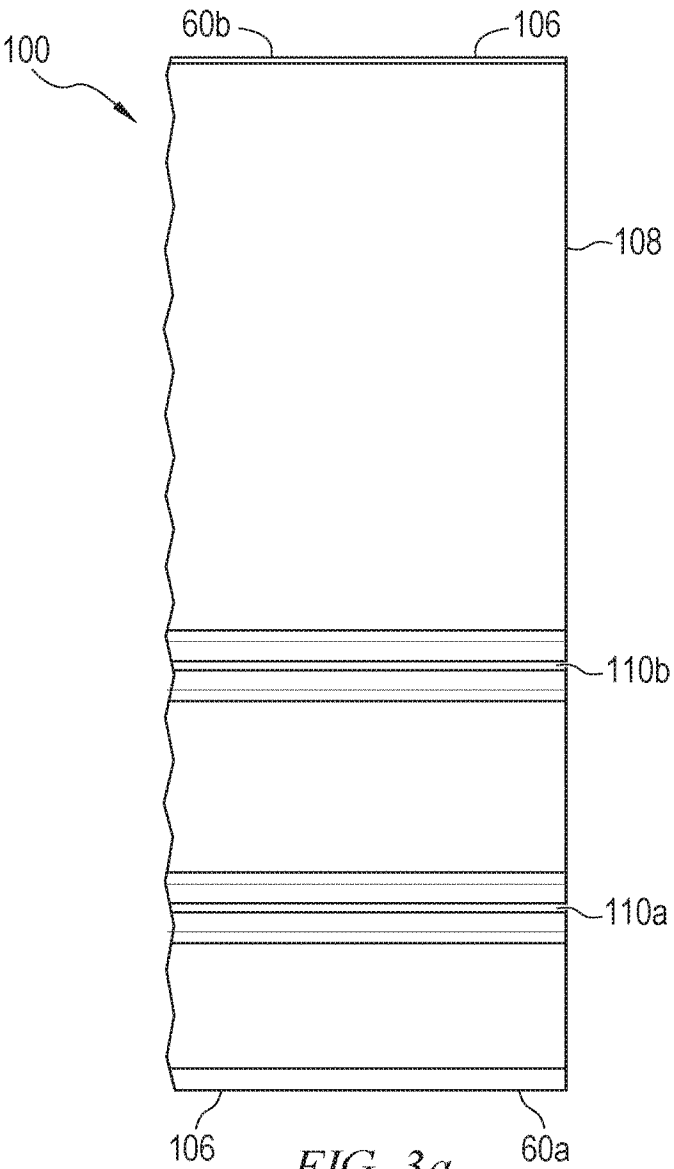

Making a stair nose out of LVP flooring involves cutting grooves into a floor plank and then folding the plank at the grooves into a stair nose shape. FIGS. 3*a* and 3*b* illustrate a floor plank 100 with a bottom surface 102 and top surface 104. Plank 100 includes two long edges 106 and two short edges 108. Plank 100 has a width extending from one long edge 106 to the other, a length extending between the two short edges 108 parallel to the long edges, and a thickness extending between top surface 104 and bottom surface 102. Planks 100 have a latching mechanism built into the edges as connectors 60*a* and 60*b*, so the opposing long edges 106 are designed to interface with each other and the opposing short edges 108 are also designed to interface with each other. A connector 60 of a short edge 108 could interface with a connector of a long edge 106 if the installer wanted to get creative. Connectors 60 are optional, and some LVP flooring planks simply have flat surfaces that are designed to contact each other when installed without latching or otherwise interfacing with each other.

Two grooves 110*a* and 110*b* are formed into bottom surface 102, but not completely through plank 100 to top surface 104. FIG. 3*c* shows additional detail of grooves 110. Grooves 110 allow plank 100 to be folded 90-degrees along each of the grooves, thus turning the plank into a stair nose. Grooves 110*a* and 110*b* are substantially identical to create two 90-degree angles along the length of plank 100. Grooves 110 each include a horizontal surface 112, two vertical surfaces 114, and two diagonal surfaces 116. Diagonal surfaces 116 connect bottom surface 102 of plank 100 to the two vertical surfaces 114. Vertical surfaces 114 connect diagonal surfaces 116 to horizontal surface 112. Horizontal surface 112 is the deepest part of grooves 110 and connects the two vertical surfaces 114 to each other. Horizontal surface 112 is considered the bottom of groove 110 due to being the deepest part of the cut.

In the illustrated embodiment, plank 100 is 8 millimeters (mm) thick, and groove 110 is formed to a depth of 7 and ⅓ mm, leaving a thin flat flexible portion 120 between horizontal surface 112 and top surface 104 with a thickness of ⅔ mm. A thickness of ½ mm is left as flexible portion 120 in other embodiments. The depth of groove 110 can be formed as close to image layer 56 as possible without damaging the image layer. Ideally core 52 would be completely removed but doing so without damaging printed layer 56 can be a challenge. Accordingly, a thin portion of core 52 is typically left under horizontal surface 112 by design. Core material 52 is flexible enough that a thin layer remaining still allows plank 100 to be folded at groove 110. In one embodiment, groove 110 is formed to leave a fixed thickness of plank 100 in flexible portion 120 so that the remaining thickness of core 52 will depend on the total thickness of image layer 56 and clearcoat layers 58.

The width of horizontal surface 112, and therefore the width of flexible portion 120 and the distance between vertical surfaces 114, is 3.2 mm. Vertical surfaces 114 have a height of 1.6 mm, and diagonal surfaces 116 each extends off at a 45-degree angle from a respective vertical surface to bottom surface 102. At bottom surface 102, diagonal surfaces 114 are approximately 0.5772 inches or 14.66 mm apart. Horizontal surface 112, vertical surfaces 114, and diagonal surfaces 116 all extend in the same profile shape for the entire length of plank 100. Any of the above measurements can be customized as needed for different plank types, compositions, sizes, etc. to ensure that diagonal surfaces 116 make proper contact when folded.

Grooves 110 with a flat horizontal surface 112 at the bottom of the grooves leaves a flat flexible portion 120 of plank 100 between horizontal surface 112 and the plank's top surface 104. Flexible portion 120 has a relatively uniform thickness for a significant width, which allows plank 100 to bend uniformly along the entire width of horizontal surface 112 when the plank is folded. Diagonal surfaces 116 could meet at a point at the bottom of the groove, but bending of plank 100 would occur over a much thinner area of plank 100 and risk tearing of image layer 56. For planks that are not as flexible, horizontal surface 112 can be made wider, allowing the plank to bend across a wider arc, or portion 120 can be made thinner to flex easier.

Each diagonal surface 116 is at a 45-degree angle so that the angle between the two diagonal surfaces is 90 degrees. When plank 100 is bent across groove 110, diagonal surfaces 116 contact each other when the plank is flexed to the same angle as exists between the diagonal surfaces. For a 90-degree bend in plank 100, diagonal surfaces 116 should make a 90-degree angle when formed. A non-symmetrical groove could be formed with, e.g., one diagonal surface 116 at a 30-degree angle and the other at a 60-degree angle, and the diagonal surfaces would still meet when plank 100 is bent to 90 degrees. Plank 100 can be folded or bent at non-right angles by varying the total angle between diagonal surfaces 116.

The height of vertical surfaces 114 in combination with the width of horizontal surface 112 controls how diagonal surfaces 116 meet when plank 100 is folded. The ideal is to have diagonal surfaces 116 lie flat on each other perfectly aligned so that the entire area of each diagonal surface is contacted by the other diagonal surface. If vertical surfaces 114 are made too short, the top edges of diagonal surfaces 116 will meet first and the diagonal surfaces will not fully touch. If vertical surfaces 114 are made too tall, the bottom edges of diagonal surfaces 116 will meet first and make full contact difficult. The above listed dimensions were found through trial and error to be optimal for most LVP flooring on the market today. However, if diagonal surfaces 116 are not meeting each other properly in practice, some dimensional adjustment might help.

Figure 3D:
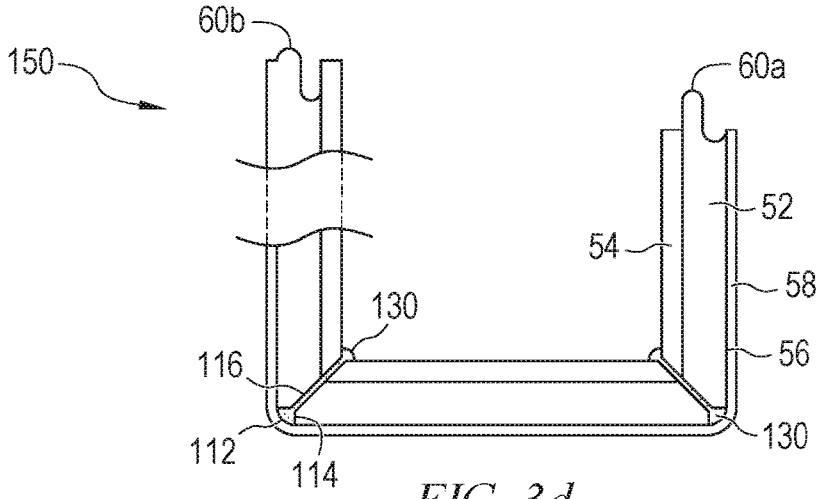

FIG. 3*d* shows plank 100 bent across both grooves 110 to 90-degree angles and glued in place so that the angles are maintained. Adhesive 130 is disposed in grooves 110 prior to folding plank 100. Diagonal surfaces 116 of each groove 110 contact each other with a thin layer of adhesive 130 between them. Vertical surfaces 114 now form a 90-degree angle, and horizontal surface 112 curves to connect the ends of vertical surfaces 114.

A gap between horizontal surface 112 and vertical surfaces 114 is shaped like an isosceles right triangle with an outwardly curved hypotenuse. The gap should be filled with adhesive 130 with as few voids as possible to maximize hold of the plank 100 folds. Thorough application of adhesive 130 can be confirmed by viewing a bead formed by the adhesive being squeezed out of groove 110 during folding. If the bead of adhesive 130 is continuous along the length of plank 100 then the gap between horizontal surface 112 and vertical surfaces 114 is likely to be filled with adhesive. Small breaks in the bead of adhesive 130 are likely fine, but long breaks in the bead may indicate an adhesive void in groove 110 at that location.

Figure 3E:
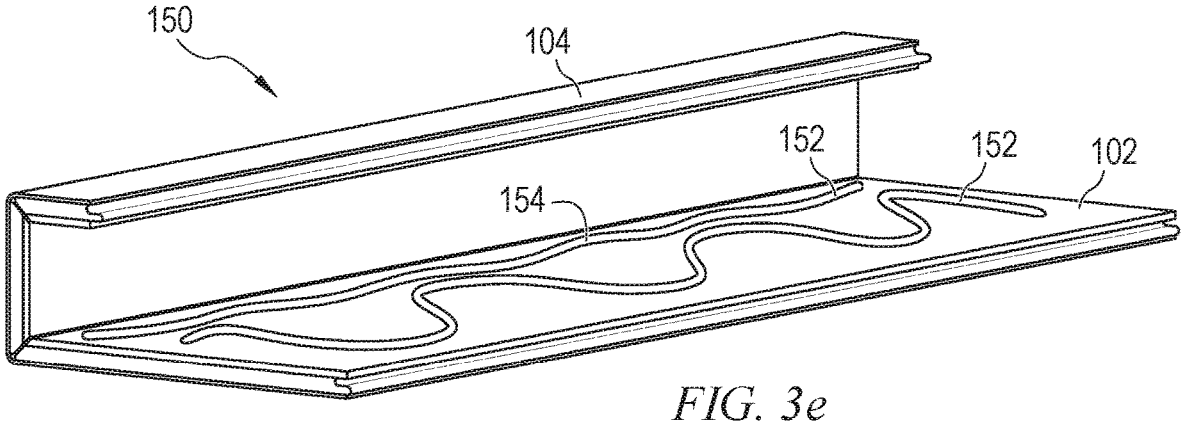

Bending and gluing both grooves 110 to 90-degree angles completes the transformation of plank 100 into a stair nose 150. Stair nose 150 is ready to be put into service on a stair step. To install stair nose 150, glue or adhesive 152 is first applied to bottom surface 102 as shown in FIG. 3*e*. Adhesive 152 can be applied directly to padding 54. Liquid nails or any type of industrial adhesive can be used. In some embodiments, planks 100 can be manufactured in two different varieties: normal planks with padding 54 for the main floor and planks without padding for stair noses. Both plank varieties are still manufactured together in the same factory to have closely matching color and pattern styles. Leaving padding 54 off planks 100 destined for being made into stair noses 150 has the added benefit that the bead of adhesive 130 that squeezes out of groove 110 sits on core 52 instead of padding 54, which provides a stronger adhesive bond.

Figure 3F:
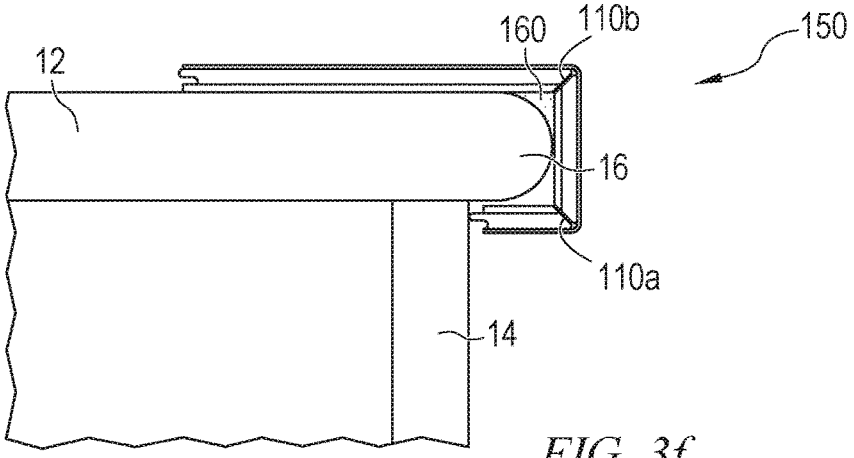

Adhesive 152 is applied to bottom surface 102 in sufficient quantity to adhere stair nose 150 to the underlying stair tread 12. In addition, a bead 154 of adhesive 152 is applied over the folded groove 110*b* so that, when stair nose 150 is installed on a stair step as shown in FIG. 3*f*, a gap 160 in the upper corner is substantially filled with adhesive. Filling gap 160 with adhesive 152 structurally supports the corner of stair nose 150 and reduces the likelihood of a heavy stepper breaking or bending the stair nose. For the best structural support, nose 16 of tread 12 should physically contact bottom surface 102 of stair nose 150 between grooves 110*a* and 110*b*. If the bottom section of stair nose 150 is too long such that riser 14 is contacted before nose 16, then the bottom end of stair nose 150 can be cut off as shown below in FIG. 3*i* to allow nose 16 to be contacted.

Figure 3G:
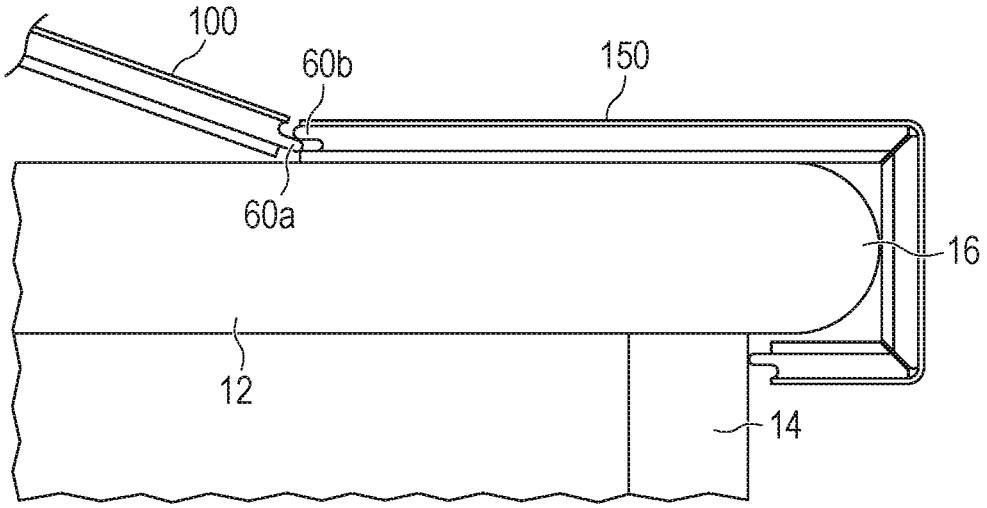
Figure 3H:
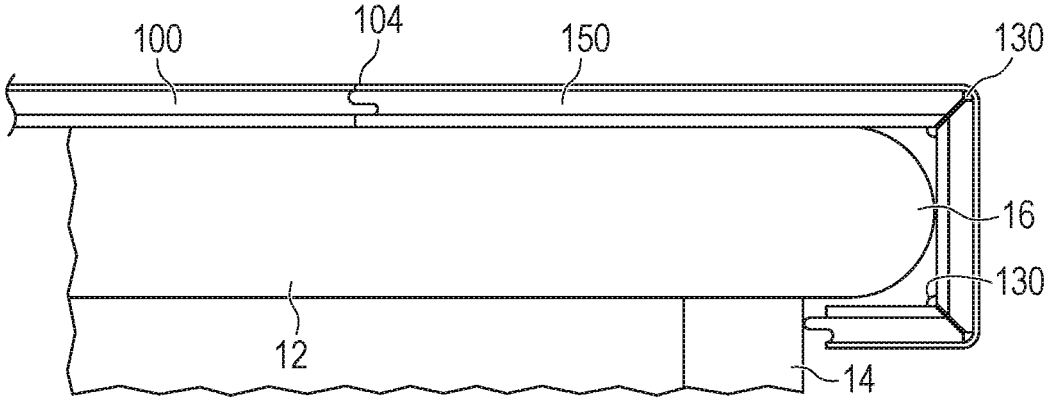

With stair nose 150 installed, additional planks 100 can be laid next to the stair nose to continue the rest of the floor as shown in FIGS. 3*g* and 3*h*. Connector 60*a* of plank 100 is interfaced with connector 60*b* of stair nose 150. As plank 100 is laid down next to stair nose 150, connectors 60 snap together and create a nearly seamless top surface 104 between the two. For an intermediate stair step, a single plank 100 may be enough to cover the stair tread. Plank 100 may be cut to size so that connector 60*b* is removed and the plank ends at or just short of the riser of the next step. For the top stair step, additional planks 100 are added until the desired floor area is covered. Both plank 100 and stair nose 150 can be cut to length appropriate for the stairs being covered. Using the same planks 100 to form stair nose 150 as well as to cover the surrounding floor area results in a uniform look with consistent color and pattern across the entirety of the floor and stairs.

Figure 3I:
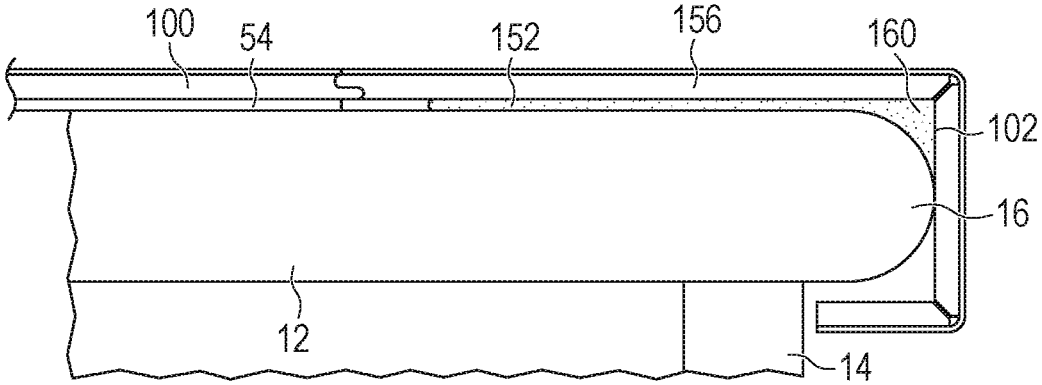

FIG. 3*i* shows a stair nose 156 made from a plank 100 without padding 54 on the bottom of the plank. Stair nose 156 is otherwise structured and manufactured the same as stair nose 150. The folded corners of stair nose 156 are stronger than those of stair nose 150 due to adhesive 130 gripping directly to core 52 without the intervening padding 54. Adhesive 152 between bottom surface 102 and tread 12 functionally and structurally replaces padding 54. Adhesive 152 fills gap 160 in the corner to structurally support stair nose 156. The bottom end of stair nose 156 is cut so that nose 16 of tread 12 contacts bottom surface 102 between the two folds. Planks 100 forming the rest of the floor adjacent to stair nose 156 are formed with padding 54, but still match properly due to being manufactured together at the same factory with the planks used to form the stair nose.

Figure 4C:
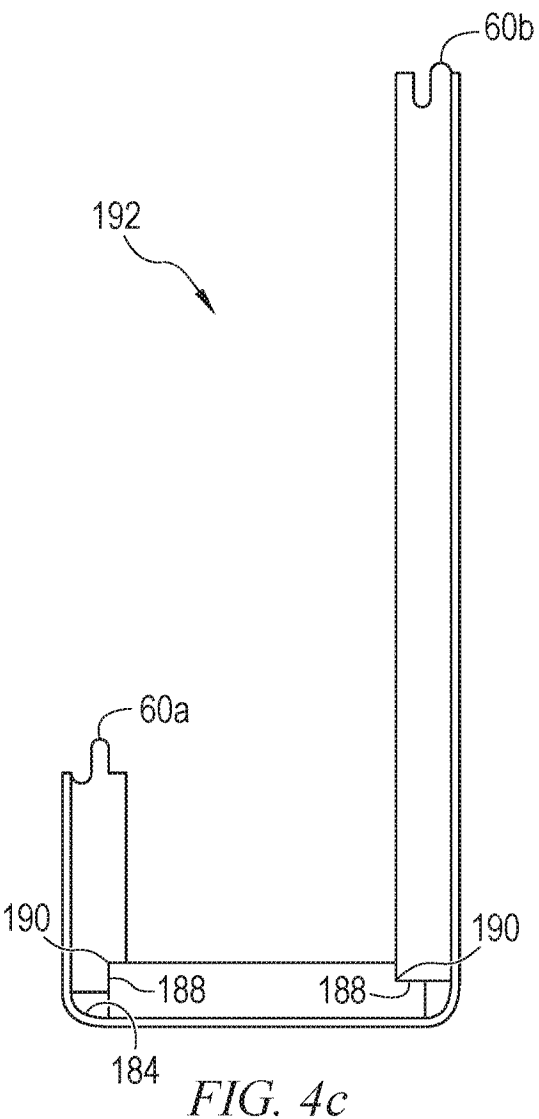
FIGS. 4*a*-4*c* illustrate an alternative groove cut profile.
Figure 4B:
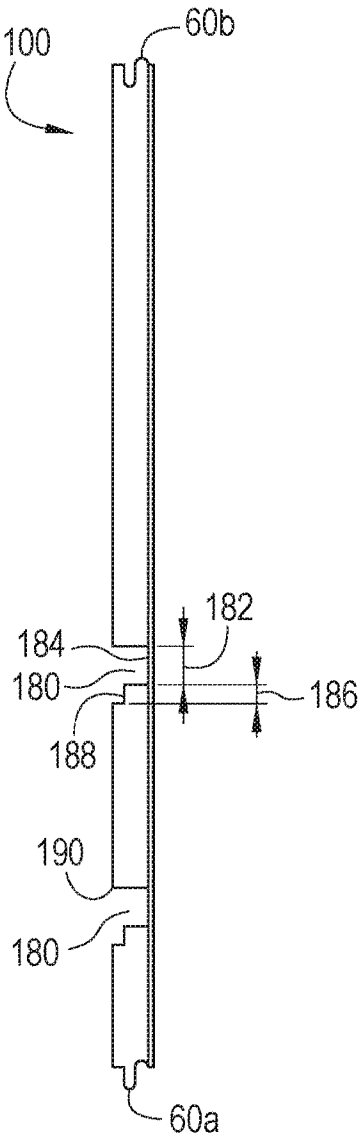
Figure 4A:
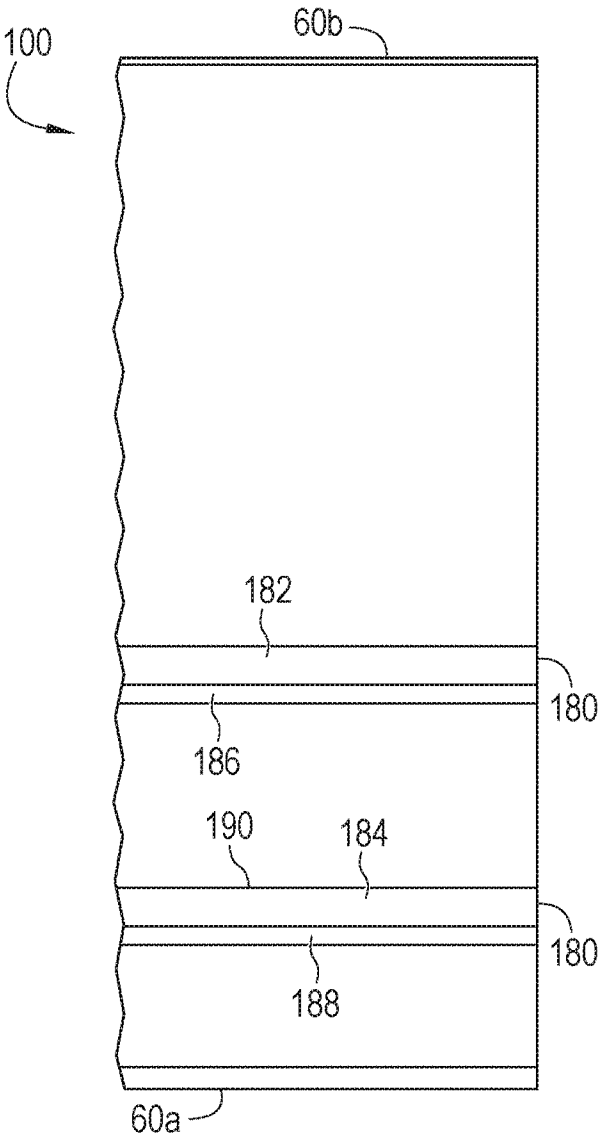

FIGS. 4*a*-4*c* show an alternative groove profile for converting plank 100 into a stair nose. FIG. 4*a* shows a plan view, FIG. 4*b* shows a cross-sectional view, and FIG. 4*c* shows plank 100 folded into stair nose 192. Grooves 180 are formed with all square cuts and no diagonal surfaces, which can make manufacturing easier due to the use of blades with perpendicular angles. Grooves 180 include a deep cut 182 to form a flexible portion 184 and a shallow cut 186 to form a shelf 188. Flexible portion 184 is a thin portion of plank 100 with a uniform thickness across a significant width, similar to flexible portion 120 above. Deep cut 182 and shallow cut 186 can be formed using a single saw blade with an appropriate profile shape or using two or more separate saw blades. Deep cut 182 forms a corner 190 opposite shelf 188.

Flexible portion 184 is similar to flexible portion 120 in groove 110, and is formed with a thickness of about ⅔ mm. Some core 52 remains in some embodiments. The width of flexible portion 184 is two to three times greater than the width of flexible portion 120 because the square cut in FIGS. 4*a* and 4*b* will have to cover a large physical distance when plank 100 is folded across groove 180. Shelf 188 is formed about 1.6 mm deep and 3.2 mm wide. The dimensions of groove 180 can be adjusted as necessary to allow plank 100 to fold properly across the groove.

FIG. 4*c* shows plank 100 folded across grooves 180 to form a stair nose molding 192. The dimensions of groove 180 are selected so that corner 190 sits on shelf 188 when plank 100 is folded to a 90-degree angle. Groove 180 is filled with adhesive prior to folding, which fills the gap remaining in deep cut 182 after folding. Shallow cut 186 is filled with the plank material from corner 190. Groove 180 provides easier manufacturing due to a simpler cut profile and creates a broader radius for the 90-degree bend, which means flooring planks that do not bend as easily can be used. The larger radius bends of grooves 180 may also be a desirable aesthetic choice for some people.

Figure 5B:
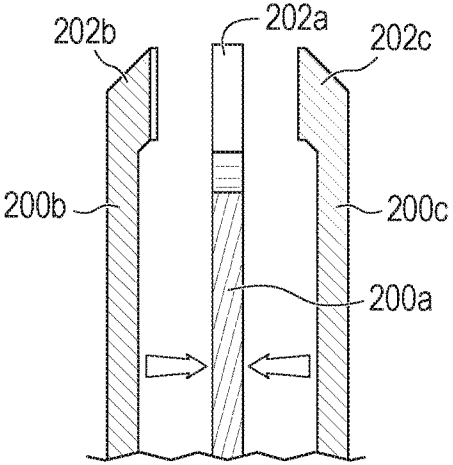
FIGS. 5*a*-5*e* illustrate saw blades used to cut grooves into the luxury vinyl plank for folding.
Figure 5C:
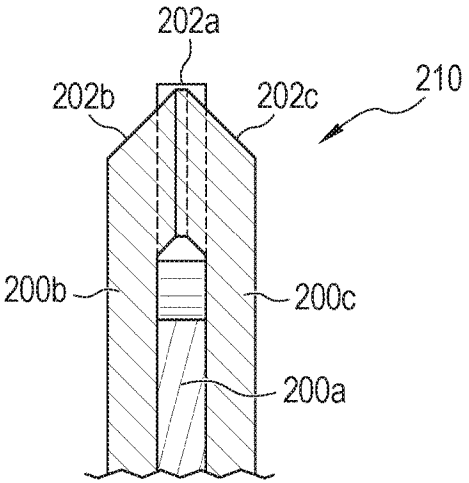
Figure 5A:
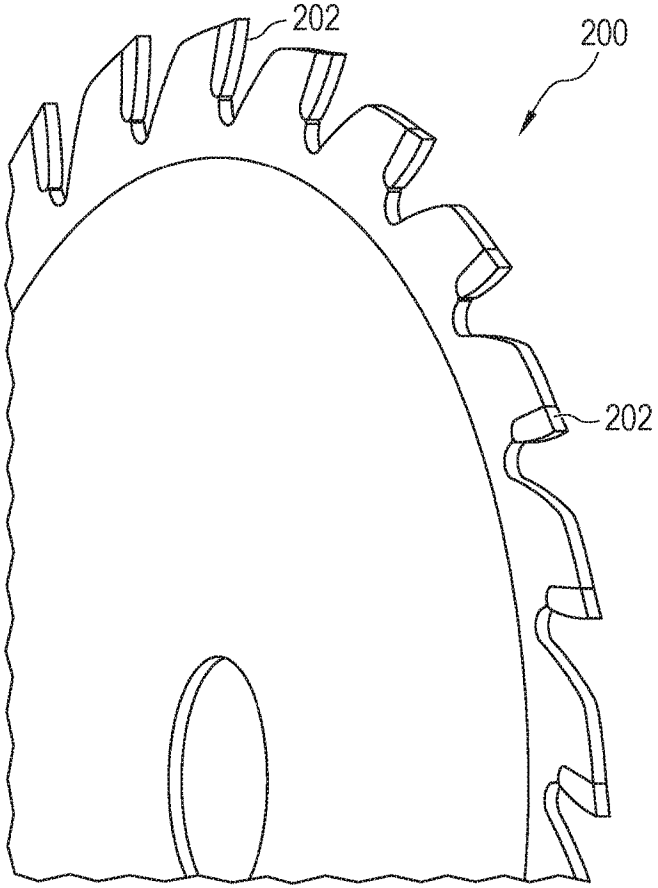

FIGS. 5*a*-5*e* illustrate saw blades usable to cut grooves 110. One way to cut groove 110 is to take three normal table saws and shape their teeth to form the three different groove regions, i.e., horizontal surface 112 and the two diagonal surfaces 116. FIG. 5*a* shows a normal circular saw blade 200 that can be used. Teeth 202 on blade 200 can be shaped as necessary. Buying a blade 200 with as large of teeth 202 as possible will provide the greatest flexibility in shaping the teeth to the desired profile.

FIG. 5*b* shows three saw blades with their teeth cut to make the profile of groove 110. Middle blade 200*a* has rectangular teeth 202*a*, shaped to the desired width of horizontal surface 112, e.g., 3.2 mm. Outer blades 200*b* and 200*c* are shaped to have teeth 202*b* and 202*c* with 45-degree outer surfaces to correspond to the desired cuts for diagonal surfaces 116. Outer blades 200*b* and 200*c* may be made from the exact same circular saw blades as middle blade 200*a*, or a lower diameter blade may be used. Teeth 202 can be shaped using sanding, grinding, or another suitable process.

With blades 200*a*-200*c* ground down to the desired shapes, the three blades are combined to operate as a single blade on a table saw. FIG. 5*c* illustrates the combined blade 210. Outer blades 200*b* and 200*c* are rotated slightly toward or away from the viewer so that teeth 202 of the outer blades are interleaved between the teeth of middle blade 200*a*. That rotation allows teeth 202*b* and 202*c* of outer blades 200*b* and 200*c* to extend toward each other into the cut profile of middle blade 200*a* between teeth 202*a*. The angled edges of teeth 202*b* and 202*c* are usually longer than angled surfaces 116 of the resultant grooves 110.

Combined blade 210 has the appropriate profile to cut groove 110 due to being cut to the proper dimensions. However, the individual blades 200 will eventually need to be sharpened. Keeping the proper saw blade profile after sharpening can be a challenge. The profile of combined blade 210 can be adjusted by adding shims or washers 212 between the individual blades 200*a*-200*c* as shown in FIG. 5*d*. Moving outer blades 200*b* and 200*c* in the X direction on the illustrated axis adjusts the height in the Y direction where the tops of the outer blades meet middle blade 200*a*. Because the cut angle is 45 degrees, the distance of movement in the X direction will result in an equal distance being added to or removed from vertical surfaces 114 in grooves 110. Shims 212 allow adjustment of the profile of combined blade 210 to make sure that groove 110 is properly dimensioned.

Figure 5E:
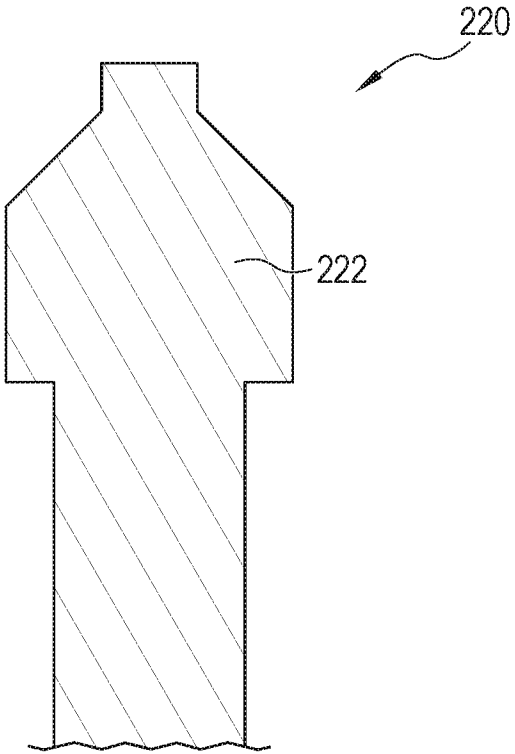
Figure 5D:
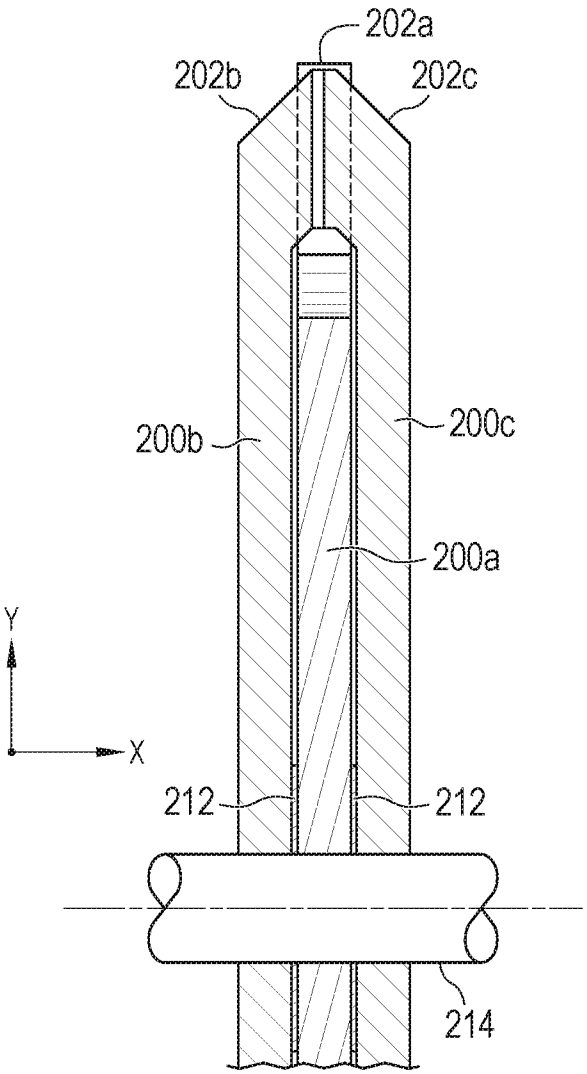

As an alternative, FIG. 5*e* shows a blade 220 that is a single blade with each individual tooth 222 manufactured in the profile for grooves 110. Having a single blade 220 means that the profile can no longer be adjusted using shims 212, but also means that sharpening teeth 222 into the profile of groove 110 is easier. Grooves 110 can also be cut using a router bit with the appropriate profile for cutting grooves 110. However, using a router bit has the downside of being difficult to sharpen without permanently changing the profile shape.

Figure 6B:
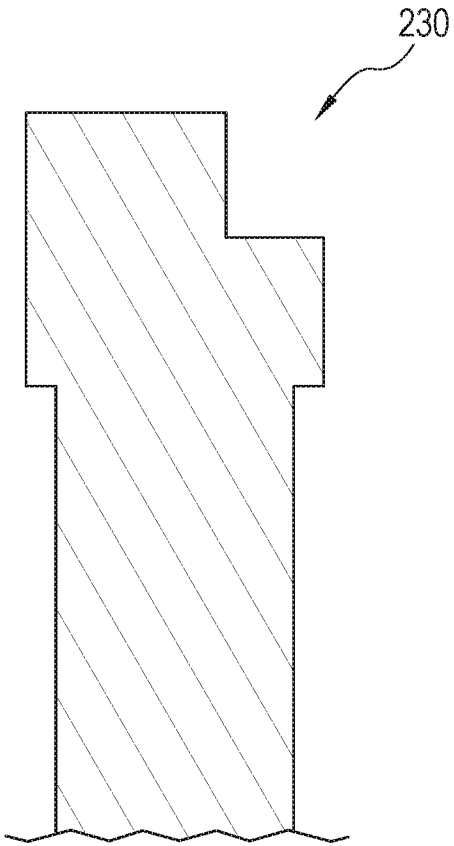
FIGS. 6*a* and 6*b* illustrate saw blades used to cut the alternative groove profile.
Figure 6A:
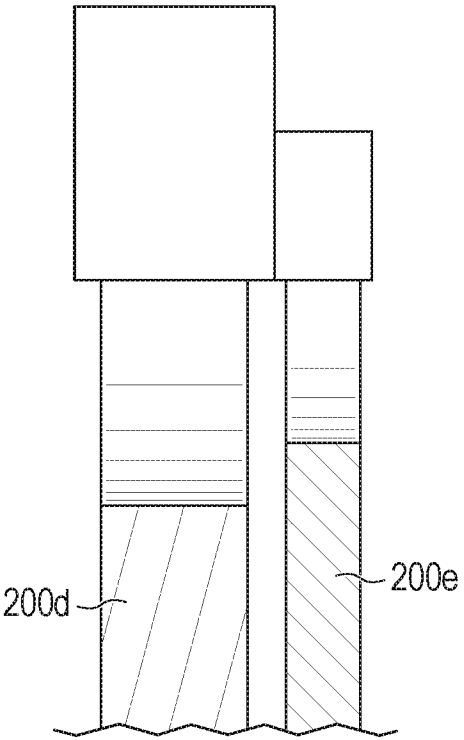

FIGS. 6*a* and 6*b* illustrate a similar concept for saw blades used to form grooves 180. Two rectangular blades 200*d* and 200*e* can be combined as shown in FIG. 6*a*. Blade 200*d* has a larger diameter for deep cut 182 and blade 200*e* has a smaller diameter for shallow cut 186. Again, blades 200*d* and 200*e* can be made from the same input blades, with blade 200*e* simply having more of each tooth removed to reduce the overall diameter and width. Depending on the width of deep cut 182, two or more saw blades may be combined to form the deep cut while a third makes shallow cut 186. FIG. 6*b* shows a single blade 230 with each tooth having the profile of groove 180.

To create grooves using the above blades, the blades are installed into a table saw and planks 100 are run across the table saw. The cutting process begins by optionally heating up planks 100. A stack or pallet of planks can be placed in a heated area or container prior to having grooves cut. A bread proofing box can be used for instance. Heating planks 100 prior to cutting grooves makes clearcoat layers 58 more flexible, thus helping reduce the likelihood that the clearcoat layers will chip during the sawing process. Planks 100 are heated to 98 degrees Fahrenheit (° F.) in one embodiment.

Figure 7A:
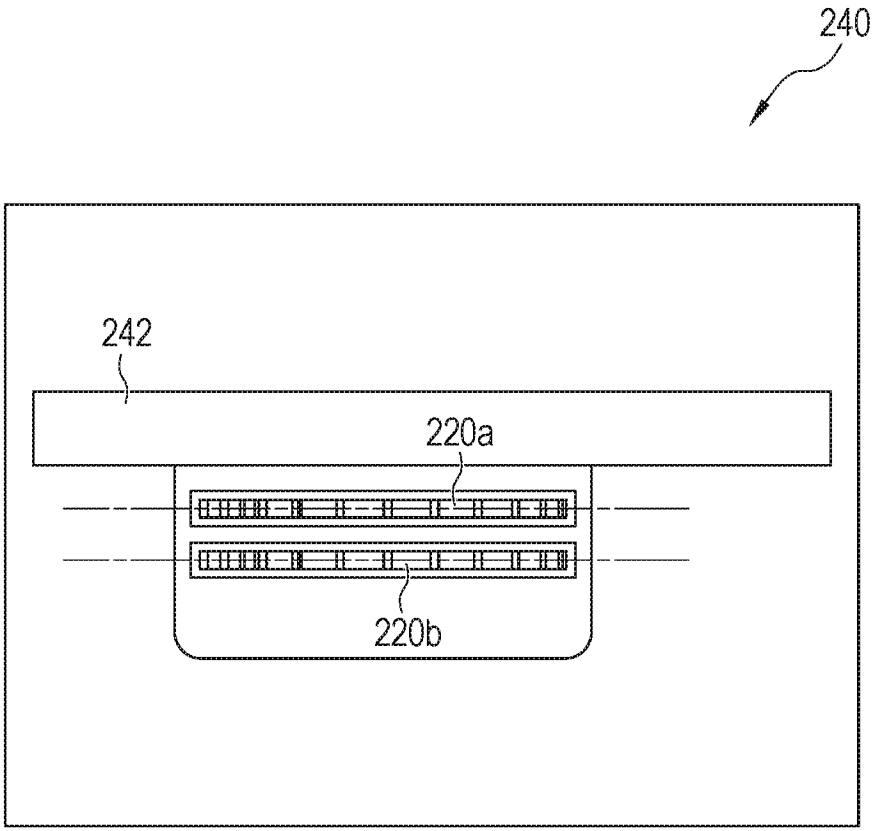
FIGS. 7*a*-7*c* illustrate table saw configurations used to cut grooves into luxury vinyl planks.

FIG. 7*a* shows a table saw 240 with a pair of blades 220*a* and 220*b* disposed on a single axle to cut grooves 110*a* and 110*b*, respectively. Blades 220*a* and 220*b* are set at a level where the blades cut to the desired depth into plank 100, i.e., the peak of the blades is 7 and ⅓ mm over the top surface of table saw 240 to create grooves 110 that leave flexible portion 120 with a thickness of ⅔ of a millimeter for 8 mm thick planks. A plank 100 is run across blades 220 using guide 242 to ensure that grooves 110 are positioned properly.

Figure 7B:
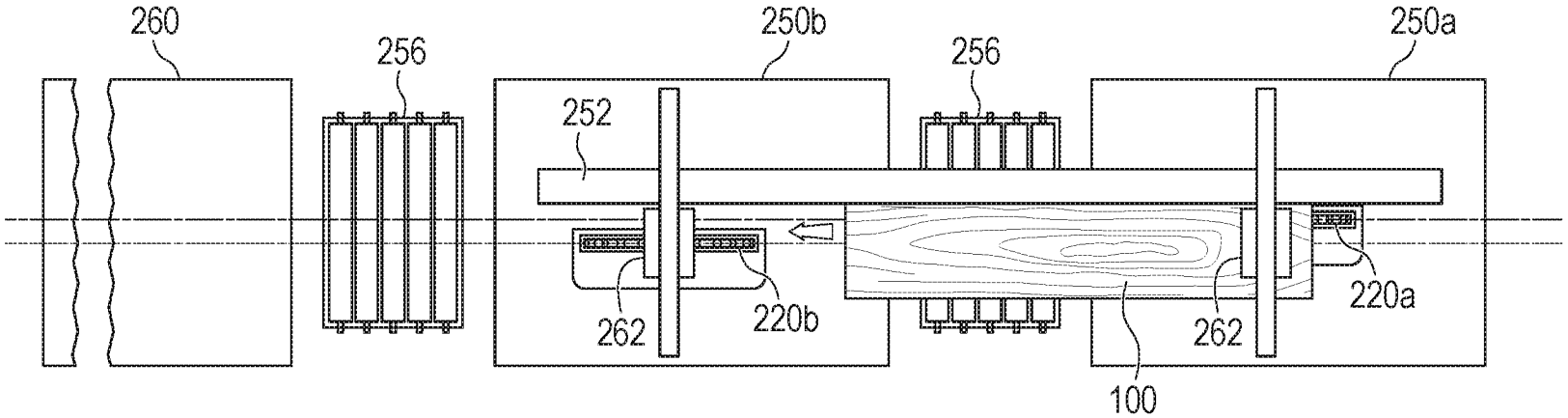
Figure 7C:
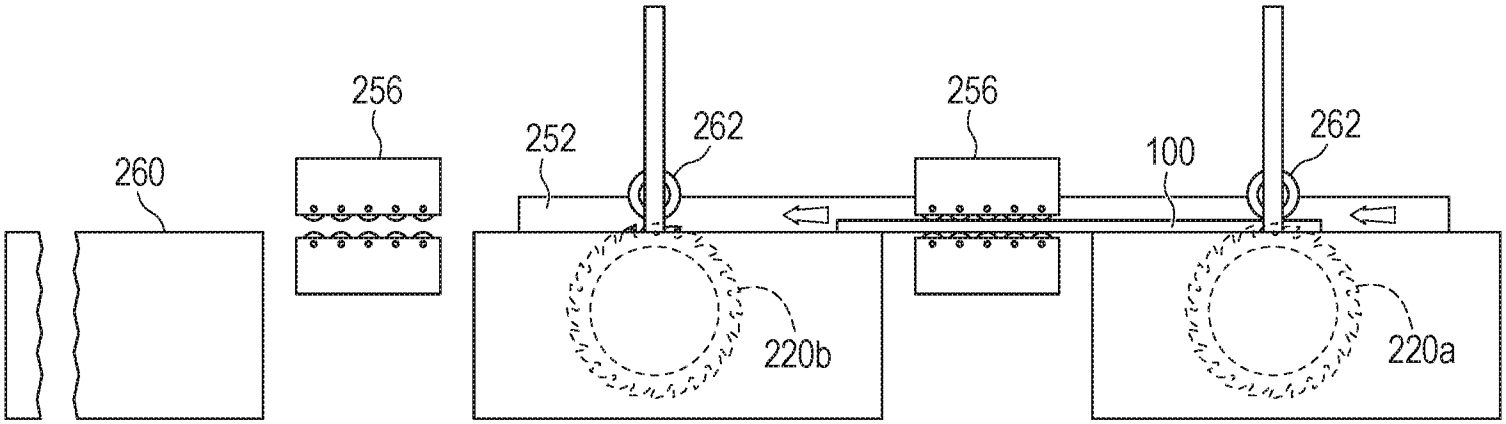

FIGS. 7*b* and 7*c* show another embodiment where two separate table saws 250*a* and 250*b* are used to cut grooves 110 one at a time. Cutting one groove at a time with two table saws 250 is a smoother and less error-prone process than doing both grooves at once. Guide 252 keeps planks 100 aligned properly relative to blades 220. The process of doing two cuts serially can be automated by using motorized rollers 256 to feed a plank 100 into the table saw setup, move the planks from table saw 250*a* to table saw 250*b*, and then drop the plank onto table 260 to await further processing. A second guide 252 can be used on the other side of planks 100 to keep the planks aligned throughout the automated process. Wheels 262 are disposed over blades 220 to keep planks 100 down on the table surface while being cut. Any type of power feeder could be used to move a plank 100 through one or two table saws. A special machine could be made to automatically cut two grooves into plank 100 instead of using two off the shelf table saws.

Figure 8A:
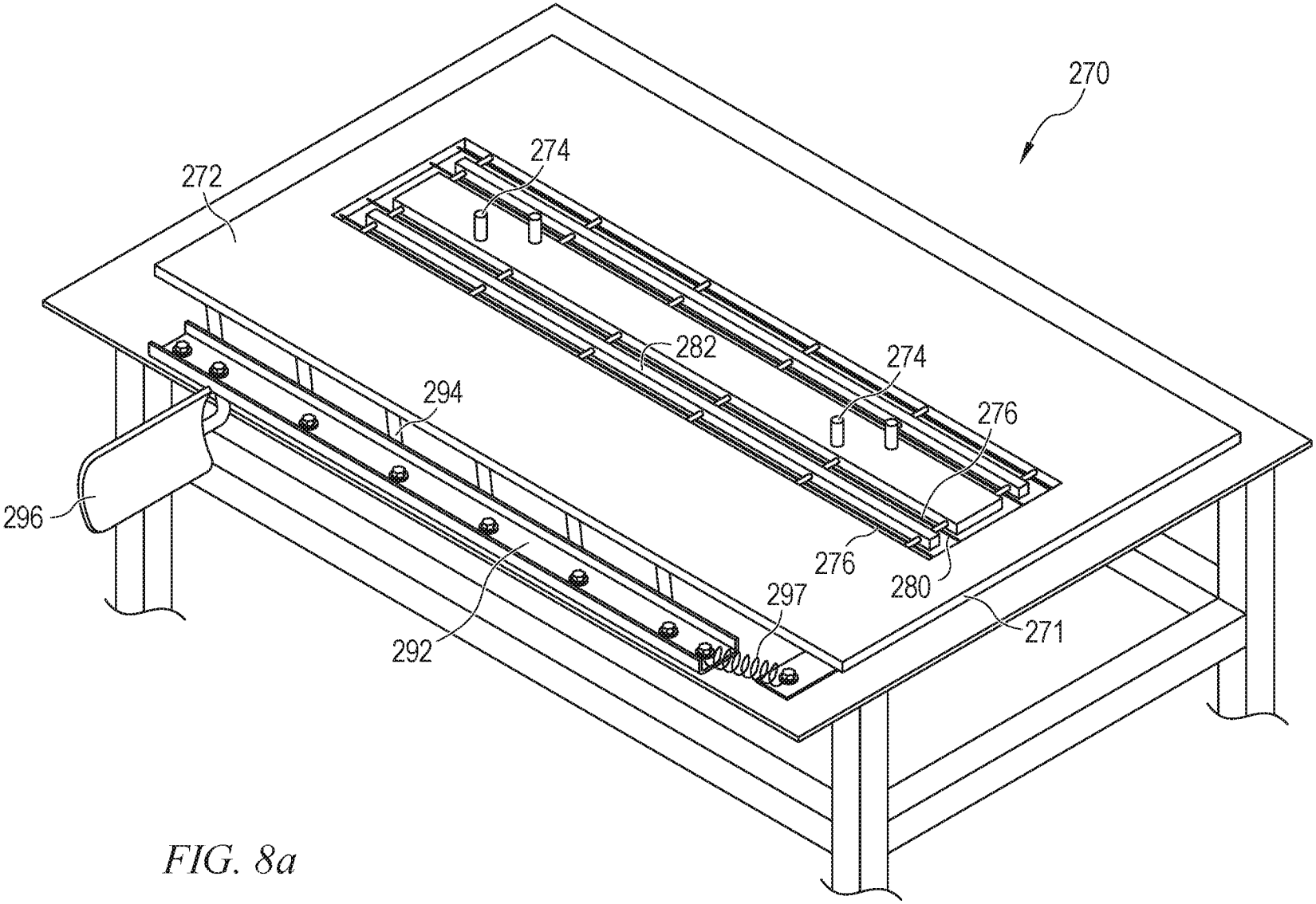
FIGS. 8*a*-8*c* illustrate a table setup to fold and glue the luxury vinyl planks.
Figure 8B:
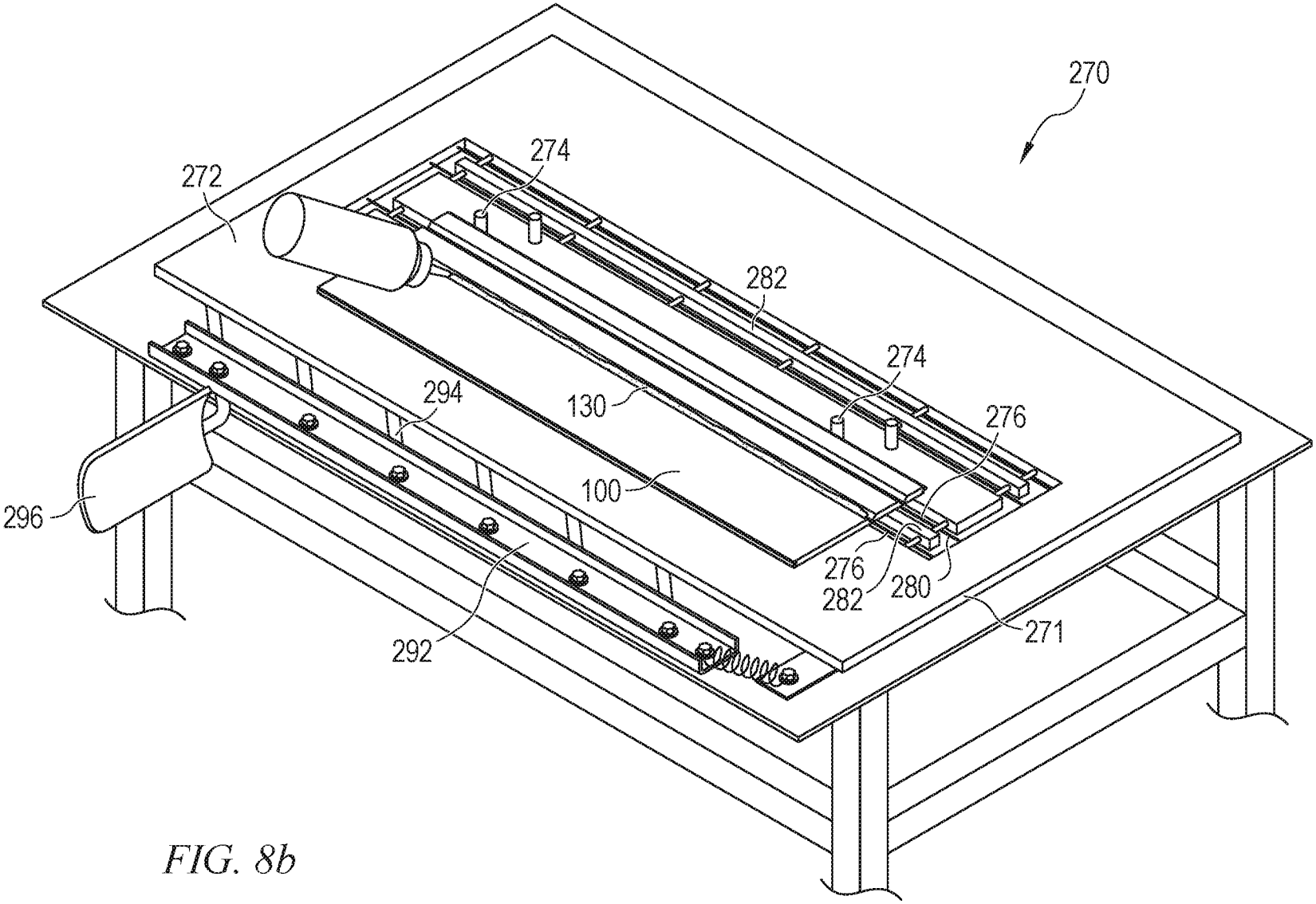
Figure 8C:
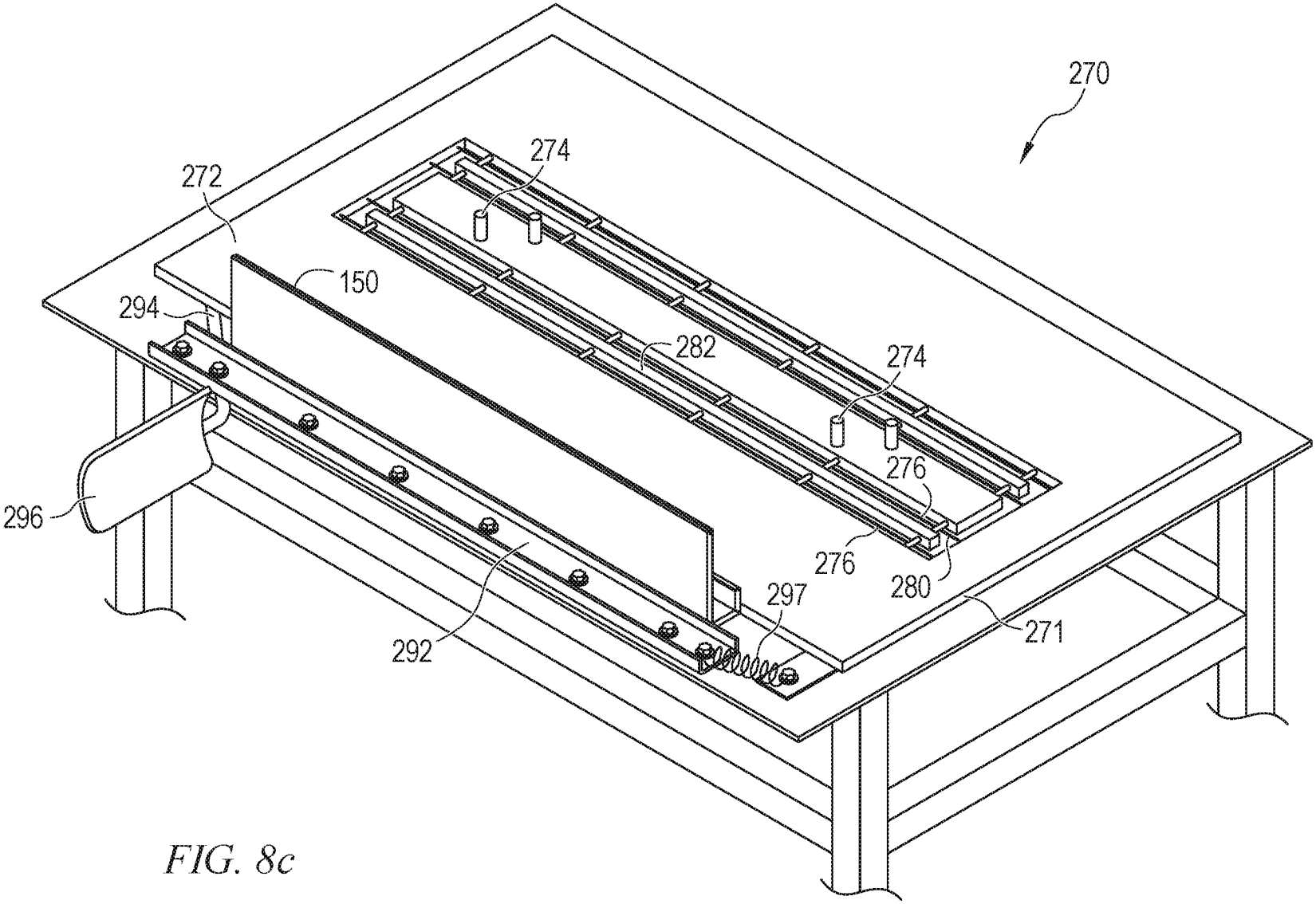

FIGS. 8*a*-8*c* illustrates a station 270 used to glue and fold planks 100 after grooves 110 are formed. Station 270 is double-sided so that two planks can be folded and glued at the same time by two different workers standing on opposite sides of the table. Station 270 includes a table 271 with a large flat working surface 272 to support a plank 100. Alignment pegs 274 are used to align plank 100 parallel to heating slots 276 with the grooves directly over the slots. Plank 100 is set on surface 272 with grooves 110 oriented upward as shown in FIG. 8*b*, and then slid back against pegs 274. Two pegs 274 are used to keep the plank 100 grooves parallel to and directly over slots 276. In other embodiments, more pegs, a flat guide surface, or any other suitable mechanism could be used to keep planks 100 positioned properly on surface 272. A worker could also just align grooves 110 over slots 276 by sight without an alignment mechanism.

A heating element 280 is disposed under slots 276. Any type of heating element is usable, e.g., a gas burner or a resistive electric heater. The heating element can be as simple as a food warmer lamp. Slots 276 are positioned directly under grooves 110 with a portion 282 of table 271 limits heat being directly applied to the portion of plank 100 between the grooves. Applying heat specifically to grooves 110 and limiting the application of heat to other areas of planks 100 helps the planks fold at the grooves without bending or being misshapen in other areas. The thinner areas of plank 100 at grooves 110 heat up more quickly than the areas remaining at full thickness, so heating just the grooves is relatively easy. A target temperature of 125° F. is sufficient for folding planks 100 and will keep the planks under most manufacturers' recommended maximum temperature.

Next, adhesive 130 is disposed into grooves 110. Adhesive 130 is a two-part adhesive in one embodiment. The two-part adhesive involves first spraying an activator into grooves 110 and then dispensing in a bead of glue. Cyanoacrylate (CA) glue is one suitable adhesive. Once the CA glue is applied onto the activator in grooves 110, the worker has about 10 seconds to fold plank 100 into the desired shape for stair nose 150 before the glue becomes too hard to work.

Another embodiment uses a single-stage hot urethane or polyurethane (PUR) adhesive. The PUR adhesive is dispensed into grooves 110 at a high enough temperature, typically 230° F., that a separate heating element 280 is not required. Using a PUR adhesive to heat the area around grooves 110 provides sufficient heat without needing heating elements 280 and keeps heat localized to the grooves without requiring slots 276. Adhesive 130 can be dispensed from a bottle, fed in from a large tank using a hose and nozzle, or applied using any other suitable mechanism.

Once adhesive 130 is disposed in grooves 110, plank 100 is folded up into two 90-degree angles and placed between table 271 and clamp bar 292 as shown in FIG. 8*c*. Clamp bar 292 runs parallel to the edge of table 271 and is attached to the table by a plurality of flat swing arms 294 that form parallelograms. The top surfaces of swing arms 294 are perpendicular to the inner surfaces of clamp bar 292 and table 271 so that together the three surfaces hold plank 100 folded into two 90-degree angles.

One of the swing arms 294 has a switch 296 extending out past clamp bar 292 that a worker can press with his or her hip to move the clamp bar away from table 271 and allow insertion of a folded-up plank 100. Clamp bar 292 is spring loaded with spring 297 so that when the worker stops pressing on switch 296 the clamp bar compresses plank 100 between the clamp bar and table 271 to hold the 90-degree folds without additional input from the worker. In other embodiments, springs 297 are used at both ends of clamp bar 292. FIG. 8*c* shows the spring compression of clamp bar 292 holding the 90-degree angles while the glue dries so that the worker can grab another plank 100 and get heat and glue applied while the first plank's adhesive dries.

The folding of plank 100 will squeeze some adhesive 130 out to form a visible bead inside stair nose 150. For two-part adhesives, an addition spray of activator can be applied after folding to ensure that the bead hardens. The activator helps adhesive 130 get a better grip on the inside of the folds and reduces the amount that the wet adhesive runs on the inner surfaces of stair nose 150. 20-30 seconds of drying is typically sufficient for adhesive 130, and then the completed stair nose 150 can be stacked for packaging and shipment to the customer.

In some embodiments, heating, applying adhesive, folding, and holding while the adhesive dries can all be automated. A robot can apply adhesive before running a plank 100 through a folding machine, such as one that might be used for roll forming sheet metal into channel beams. The entire process from loading a plank 100, cutting grooves 110 or 180, to gluing the folds in place can be automated by connecting robots in an assembly line. Robots can be configured to take a pile of new planks 100 and convert the planks into a stack of stair nosings 150 without human intervention.

In addition to stair nosing, other types of molding can be formed by cutting and folding luxury vinyl plank flooring. Any type of molding can be formed, and each has the advantage of matching the surrounding flooring due to being formed from one of the same planks that was used for the flooring.

Figure 9A:
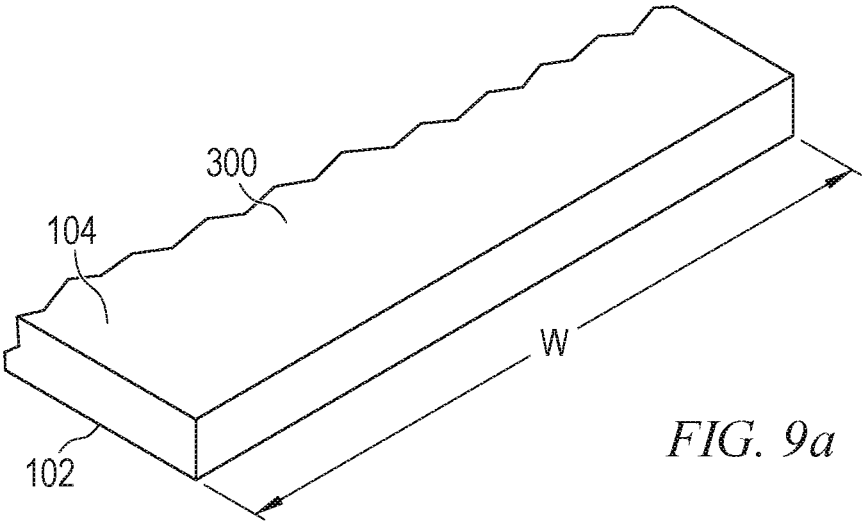
FIGS. 9*a*-9*d* illustrate forming T molding out of a luxury vinyl plank.

FIGS. 9*a*-9*d* show one example where a T molding is made from an LVP flooring plank. FIG. 9*a* shows an LVP strip 300. LVP strip 300 is formed by cutting plank 100 into strips with the desired length and width for forming a molding. The width W in FIG. 9*a* should be selected greater than the final desired width of the molding in order to accommodate the manufacturing process. In one embodiment, the additional width of strip 300 is between ½ inch and 1 inch.

Figure 9B:
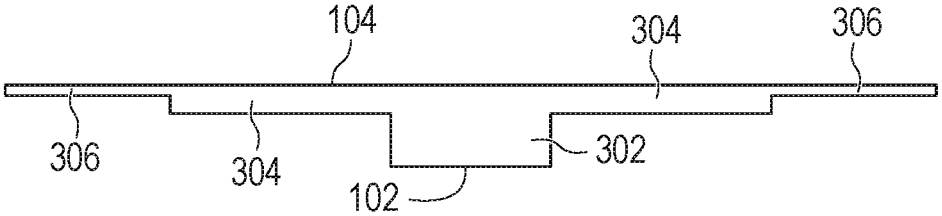

To form strip 300 into a T molding, the strip is cut or shaved down to the profile shown in FIG. 9*b*. Middle portion 302 stays at the full thickness of plank 100 and operates as the vertical portion of the T molding. Middle portion 302 can be sized as desired for the particular T molding being manufactured. In one embodiment, middle portion 302 has a width suitable for insertion into a metal track that holds the T molding in place. Middle portion 302 can be given sloped side surfaces to apply pressure against track walls as the T molding is inserted.

Platforms 304 surround middle portion 302 on both sides and have bottom surface 102 shaved down to about 20-25% of the total plank 100 thickness, i.e., about 75-80% of the plank material is removed within the footprints of platforms 304. In one embodiment, a thickness of platforms 304 is about 1 mm and a width of each platform 304 is between ¼ and ½ inch. Platforms 304 will be the portion of the T molding that sits on the surrounding flooring, while middle 302 will be the portion of the T molding that sits between the surrounding flooring.

Figure 9C:
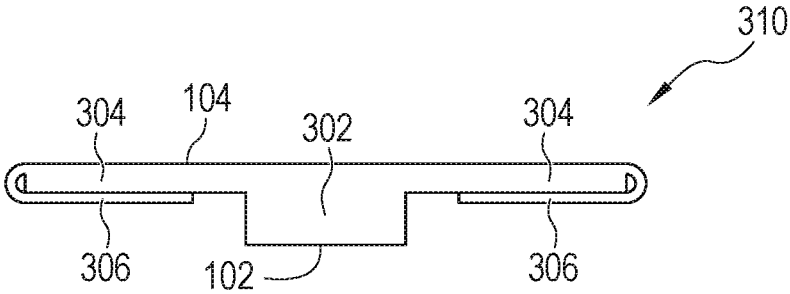

Flaps 306 have bottom surface 102 of strip 300 shaved down to between ½ mm and ⅔ mm thickness. The exact thicknesses of flaps 306 and platforms 304 are not critical, but the flaps should be thin enough to be folded under the platforms as shown in FIG. 9*c*. Platforms 304 should be thick enough to allow flaps 306 to be folded under without the platforms being bent.

Platforms 304 and flaps 306 can be cut or shaved down using a single saw with a profile matching the desired shape, as done above for grooves 110 and 180. One platform 304 and flap 306 could be cut followed by the platform and flap on the other side of middle 302. Heat can be applied as with grooves 110 and 180 to reduce the likelihood of damaging the clearcoat layers. In another embodiment, a custom planer blade is designed to cut platforms 304 and flaps 306. Any suitable tool or machine can be used to cut a plank 100 into the shape of FIG. 9*b*. A plank 100 can be cut into a plurality of T-shapes shown in FIG. 9*b* in a single step rather than first cutting down to strips 300.

Once plank 100 is cut into the shape shown in FIG. 9*b*, flaps 306 are folded under platforms 304 as shown in FIG. 9*c* and glued. Heat can be applied prior to or during folding flaps 306 to reduce the likelihood of image layer 56 and clearcoat layers 58 cracking. A CA, PUR, or other adhesive is used to fix flaps 306 to the undersides of platforms 304. The width of flaps 306 should be long enough to allow adhesive to sufficiently adhere the flaps to platforms 304 but short enough so that the flaps do not overlap middle 302 when folded under.

Figure 9D:
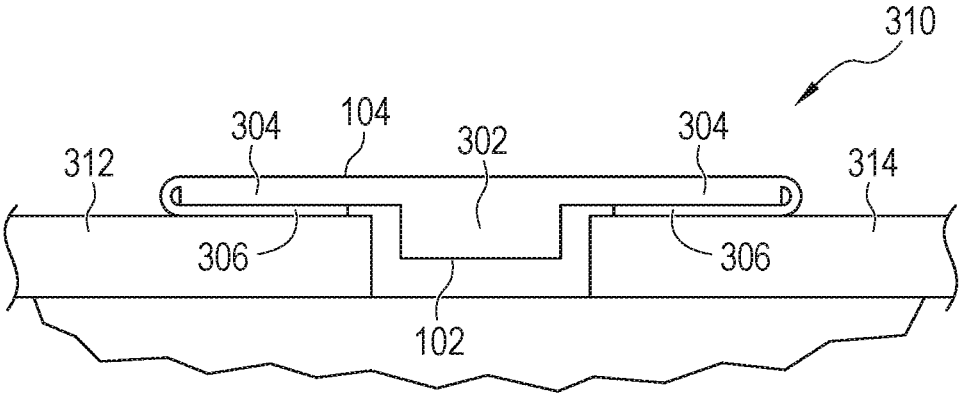

Strip 300 with flaps 306 folded under as shown in FIG. 9*c* is usable as a T molding 310. FIG. 9*d* shows T molding 310 in use. Platform 304 and flap 306 on one side of middle 302 sit on flooring 312 and the other platform and flap sit on flooring 314. Middle portion 302 extends down between flooring 312 and flooring 314. T molding 310 can be used anywhere two floorings meet. Flooring 312 might be made of planks 100 while flooring 314 is a tile floor, or the floorings could be two different patterns of LVP planks. T molding 310 can also be used where different areas of the same LVP pattern meet, e.g., if two adjacent rooms were independently covered in the same style of LVP and a molding is needed to cover up a seam between the two.

Whatever the case, T molding 310 covers up the seam where flooring 312 meets flooring 314. A seamless look by snapping connectors 60 together is difficult to get since the two flooring sides are laid independently. Flooring 312 and 314 are laid with about an inch of space between them, then the gap is covered with T molding 310. T molding 310 can optionally be glued down or snapped into a track in the gap between floorings 312 and 314. Because T molding 310 is formed from one of the same planks that are used to make one or both of floorings 312 and 314, the T molding matches the flooring almost perfectly.

FIGS. 10*a*-10*e* illustrate forming an end molding from plank 100. A strip 300 is again cut from plank 100, and then cut into the profile shown in FIG. 10*a*. Middle portion 302 again remains at the full thickness of planks 100. One side of middle portion 302 has a platform 304 and a flap 306 as with T molding 310.

Figure 10A:
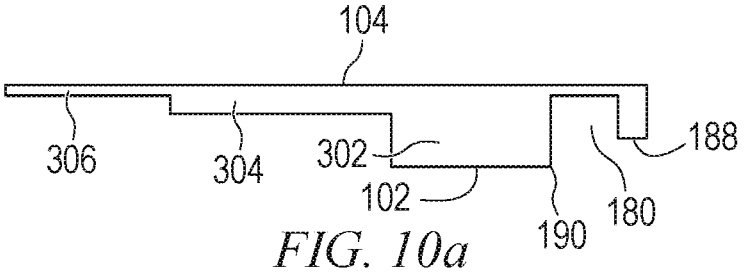
FIGS. 10*a*-10*e* illustrate forming end molding out of a luxury vinyl plank.
Figure 10B:
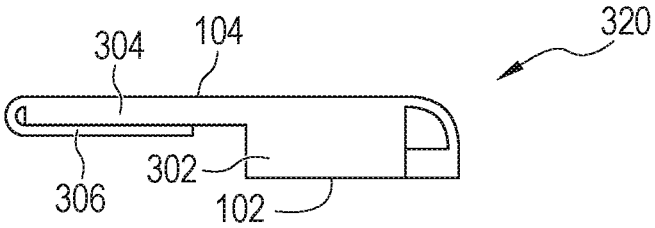

The opposite side of middle 302 has a groove 180 formed to allow that side to fold down at 90 degrees, like the folds done with stair nosing 150. FIG. 10*b* shows flap 306 folded under platform 304 and glued. Groove 180 is also folded down 90 degrees and glued as when forming stair nosing to complete an end molding 320. To use end molding 320, platform 304 and flap 306 are set on flooring as with T molding 310, and the 90-degree angle on the opposite side extends downward to the underlying floor.

Figure 10C:
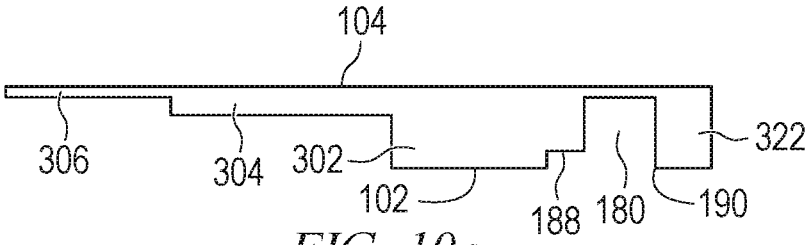
Figure 10D:
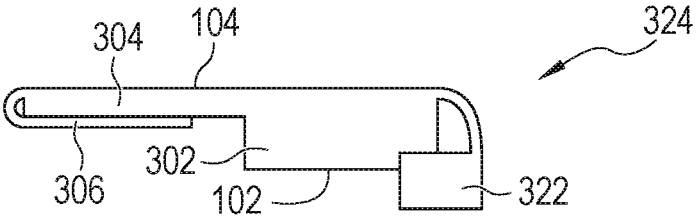
Figure 10E:
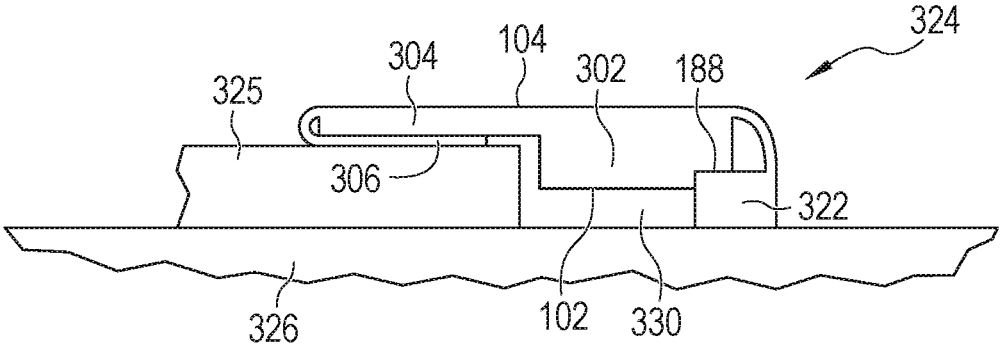

Groove 110 can be used as well as groove 180. Groove 180 is non-symmetrical and can have shelf 188 disposed toward or away from middle 302. FIGS. 10*a*-10*b* form end molding 324 with shelf 188 oriented away from middle 302, while FIG. 10*c* shows groove 180 cut into strip 300 with shelf 188 oriented toward the middle. FIG. 10*c* also shows an optional extension 322 on the opposite side of groove 180 from middle 302. Extension 322 creates vertical lift when folded down as shown with end molding 324 in FIG. 10*d*.

The vertical lift of extension 322 allows top surface 104 to stay horizontal when flooring 325 is made from the same thickness of planks 100 as end molding 324. Extension 322 sits between two parallel surfaces, i.e., floor 326 and shelf 188, which helps strengthen end molding 324 from gap 330 being crushed by a person stepping on the end molding. Gap 330 can also be filled with an adhesive or something solid like a strip of plastic, wood, or metal to further strengthen end molding 324. An additional cut could be made into middle 302 to create a structure sized to be used with a metal track nailed down to the floor.

End molding 320, with shelf 188 oriented away from middle 302, could also be made with an extension 322 to lift the grooved side of the end molding. End moldings 320 and 324 are commonly used where LVP flooring ends and a totally different type of flooring is used, e.g., carpet. End moldings 320 and 324 match flooring 325 due to being made from the same planks 100 that the flooring is made from.

The above disclosed methods and devices are described with reference to luxury vinyl plank flooring but apply equally to other types of plank flooring that are sufficiently flexible. For instance, while the illustrated embodiment is made from a luxury vinyl plank (LVP), other type of flooring planks are used in other embodiments. Stone plastic composite (SPC), wood plastic composite (WPC), and engineered vinyl plank (EVP) flooring is a non-exhaustive list of other similar types of flooring that can be used in the above-described method to form molding out of flooring planks.

While two specific groove designs are disclosed, i.e., groove 110 and groove 180, other groove profiles can be used to allow a floor plank to be bent and used as a molding. Stair noses can be made using any number and angle of folds, e.g., three 60-degree angles could be used instead of two 90-degree angles to create a pointed nose. The total of all fold angles does not necessarily need to equal 180 degrees.

While one or more embodiments of the present invention have been illustrated in detail, the skilled artisan will appreciate that modifications and adaptations to those embodiments may be made without departing from the scope of the present invention as set forth in the following claims.

What is claimed:

1. A stair nose molding, comprising:

a first flooring plank including, a core, a padding layer disposed on a first surface of the core, and an image layer disposed on a second surface of the core opposite the first surface;

a first groove formed through the padding layer and into the first flooring plank, wherein a surface of the padding layer and a surface of the first flooring plank within the first groove are coplanar; and a second groove formed through the padding layer into the first flooring plank, wherein the first groove and second groove are formed only partially through the core, and wherein the first flooring plank is folded at the first groove and second groove.

2. The stair nose molding of claim 1, wherein the first flooring plank includes a clearcoat layer disposed on the image layer opposite the core.

3. The stair nose molding of claim 1, further including a second flooring plank disposed adjacent to the stair nose molding, wherein a color and pattern of the first flooring plank and second flooring plank match.

4. The stair nose molding of claim 1, wherein a portion of the core under the first groove is bent.

5. The stair nose molding of claim 1, wherein the first groove includes a second sloped surface oriented approximately in parallel to the surface of the padding layer and the surface of the first flooring plank when the first flooring plank is folded.

6. The stair nose molding of claim 1, further including an adhesive disposed in the first groove and second groove.

7. The stair nose molding of claim 1, further including a connector formed on an edge of the first flooring plank.

8. A molding, comprising:

a flooring plank including a core, a padding layer disposed over the core, and an image layer disposed over the core opposite the padding layer; and a groove formed into the flooring plank, wherein the flooring plank is folded at the groove such that a portion of the core under the groove is bent, and wherein a surface of the padding layer in the groove is coplanar to a surface of the core in the groove.

9. The molding of claim 8, wherein the groove includes a second sloped surface oriented substantially in parallel to the surface of the padding layer and the surface of the core when the first flooring plank is folded.

10. The molding of claim 8, further including an adhesive disposed in the groove.

11. The molding of claim 8, further including a platform and a flap formed into the flooring plank, wherein the flap is folded under the platform.

12. The molding of claim 8, further including a second groove formed into the flooring plank, wherein the flooring plank is folded at the second groove such that a second portion of the core under the groove is bent.

13. The molding of claim 8, further including a first connector formed on an edge of the flooring plank.

14. The molding of claim 13, further including a second flooring plank comprising a second connector formed on an edge of the second flooring plank, wherein the first connector and second connector are interconnected.

15. A molding, comprising:

a flooring plank, wherein the flooring plank includes, a core, an image layer disposed on a first surface of the core, a clearcoat layer disposed on the image layer opposite the core, and a padding layer disposed on a second surface of the core opposite the image layer; and a groove formed into the flooring plank through the padding layer and into the core, wherein a portion of the core remains at the bottom of the groove extending across an entire width of the groove, and wherein the flooring plank is folded at the groove.

16. The molding of claim 15, wherein the groove includes a first surface and second surface oriented substantially in parallel when the first flooring plank is folded.

17. The molding of claim 15, further including an adhesive disposed in the groove.

18. The molding of claim 15, further including a connector formed on an edge of the flooring plank.

19. The molding of claim 15, further including a second groove formed into the flooring plank through the padding layer and into the core, wherein a second portion of the core remains at the bottom of the second groove extending across an entire width of the second groove, and wherein the flooring plank is folded at the second groove.

20. The molding of claim 15, wherein a surface of the padding layer in the groove is coplanar to a surface of the core in the groove.

* * * * *